United States Patent [19]

Hiejima et al.

[11] Patent Number: 4,864,088

[45] Date of Patent: Sep. 5, 1989

[54] ELECTRONICALLY CONTROLLED COOKING APPARATUS FOR CONTROLLING HEATING OF FOOD USING A HUMIDITY SENSOR

[75] Inventors: Kiyoshi Hiejima; Hiroyuki Uehashi; Yoriko Kishitani; Toshitada Kojima, all of Shiga, Japan

[73] Assignee: Sanyo Electric Co., Ltd., Osaka, Japan

[21] Appl. No.: 212,264

[22] Filed: Jun. 24, 1988

[30] Foreign Application Priority Data

| | | | |
|---|---|---|---|
| Jul. 3, 1987 | [JP] | Japan | 62-167296 |
| Jul. 20, 1987 | [JP] | Japan | 62-180506 |
| Jul. 30, 1987 | [JP] | Japan | 62-191955 |
| Mar. 17, 1988 | [JP] | Japan | 63-64307 |

[51] Int. Cl.[4] ..... H05B 6/68

[52] U.S. Cl. ..... 219/10.55 B; 219/10.55 M; 219/492; 99/325

[58] Field of Search ..... 219/10.55 B, 10.55 M, 219/10.55 E, 492, 497, 490, 491; 99/325, 327, 328, 329, 330, DIG. 14; 426/234, 243

[56] References Cited

U.S. PATENT DOCUMENTS

| | | | |
|---|---|---|---|
| 3,839,616 | 10/1974 | Risman | 219/10.55 B |
| 4,379,964 | 4/1983 | Kanazawa et al. | 219/492 |
| 4,484,065 | 11/1984 | Ueda | 219/492 |
| 4,488,026 | 12/1984 | Tanabe | 219/10.55 B |
| 4,591,684 | 5/1986 | Tanabe et al. | 219/10.55 B |
| 4,734,554 | 3/1988 | Tateda et al. | 219/10.55 B |

FOREIGN PATENT DOCUMENTS

| | | |
|---|---|---|
| 0024798 | 7/1980 | European Pat. Off. . |
| 0146406 | 12/1984 | European Pat. Off. . |
| 0238022 | 3/1987 | European Pat. Off. . |
| 3171 | 1/1983 | Japan . |
| 10738 | 3/1986 | Japan . |
| 5248 | 2/1987 | Japan . |
| 2105066 | 7/1982 | United Kingdom . |
| 2105876 | 7/1982 | United Kingdom . |
| 2173919 | 4/1985 | United Kingdom . |

*Primary Examiner*—Philip H. Leung
*Attorney, Agent, or Firm*—Darby & Darby

[57] ABSTRACT

A microwave oven mainly comprises a heating chamber (3) where food (2) is placed, a magnetron (8) for supplying microwaves to the heating chamber, a humidity sensor (11) for detecting an absolute humidity in the heating chamber, and a microcomputer (12) for controlling operation of the magnetron. The microcomputer (12) determines whether the food is covered with clear-plastic wrap or not, based on a humidity change rate at an early stage of heating. Further, the microcomputer determines the quantity of the food based on the detection of a humidity change rate at a later stage. The microcomputer determines a heating pattern suited for the state of the food, based on the two determinations.

22 Claims, 14 Drawing Sheets

ELECTRONICALLY CONTROLLED COOKING APPARATUS FOR CONTROLLING HEATING OF FOOD USING A HUMIDITY SENSOR

BACKGROUND OF THE INVENTION

1. Field of the Invention

The present invention relates to an electronically controlled cooking apparatus and more particularly to an electronically controlled cooking apparatus such as a microwave oven in which humidity in a heating chamber is detected by using a humidity sensor and food is heated dependent on the detected humidity.

2. Description of the Prior Art

It is known in the prior art that an electronically controlled cooking apparatus such as a microwave oven detects humidity in a heating chamber by using a humidity sensor and heats food dependent on the detected humidity. Such a cooking apparatus using a humidity sensor is disclosed for example in Japanese Patent Publication No. 3171/1983, 10738/1986 or 5248/1987.

However, in such a conventional cooking apparatus, it is sometimes difficult to heat food in good condition for the below described reasons.

(1) If food to be heated is covered with clear-plastic wrap, it is considerably difficult to detect reliably humidity changes caused by heating.

(2) In general, heating control patterns differ variously dependent on a quantity of food to be heated, a shape of a vessel containing the food or a shape of its lid and, accordingly, considerable difficulty is involved in appropriately applying a suitable heating control pattern based on a detected humidity.

(3) Even if the same cooking method is applied, the way in which vapor is generated from food in a heating chamber considerably differs dependent on various factors such as the quantity of food to be heated and the manner of placing a cover on a container and, consequently, if heating of the food is controlled dependent on the detected humidity according to the same cooking sequence, a satisfactory result of cooking cannot always be obtained.

(4) If an initial temperature of food is high or a very small quantity of food is to be cooked, the food is rapidly heated to an excessively high temperature before a suitable heating control pattern is determined based on detection of a humidity change in heating, which entails a danger of firing.

The U.S. Pat. No. 4,484,065 discloses a heating apparatus which determines whether a heated object is covered tightly or not, dependent on a change rate of humidity in a heating chamber and selects a suitable heating sequence based on the determination. However, in such a heating apparatus, the humidity change rate is detected only once at an early stage of heating and determination as to a covered state and selection of a heating pattern to be applied thereafter are made only based on the result of this single detection. Accordingly, it is difficult to apply fine heating control to obtain a good result of cooking.

SUMMARY OF THE INVENTION

Therefore, an object of the present invention is to provide an electronically controlled cooking apparatus capable of accurately determining a state of food to be heated by using a humidity sensor and performing appropriate heating control.

Another object of the present invention is to provide an electronically controlled cooking apparatus capable of performing appropriate heating control based on a detected humidity even if food to be heated is covered with wrap.

Still another object of the present invention is to provide an electronically controlled cooking apparatus capable of appropriately applying different heating control patterns based on humidity detected by a humidity sensor.

A further object of the present invention is to provide an electronically controlled cooking apparatus capable of obtaining a constantly satisfactory result of cooking by using the same cooking method, even if vapor is generated from food into a heating chamber in different manners dependent on a quantity of the food, the manner of placing a cover over the container or other factor.

A still further object of the present invention is to provide an electronically controlled cooking apparatus which can prevent rapid heating of food to an excessively high temperature before determination of a suitable heating control pattern based on a detected humidity during heating, thereby to remove the danger of firing.

Briefly stated, the present invention comprises an electronically controlled cooking apparatus comprising: a heating chamber for containing an object to be heated, means for heating the contained object to be heated, a sensor for detecting a humidity in the heating chamber, and a control portion for controlling heating operation of the heating means depending on the detected humidity in the heating chamber. The control portion evaluates a humidity change rate in the heating chamber at an early stage of the heating operation based on the detected humidity and determines a state of the object to be heated based on the evaluated humidity change rate, and it evaluates specified factors concerning the state of the object heated in the subsequent heating operation and determines the state of the object based on the evaluated specified factors, and then, it determines a heating pattern suitable for the state of the object based on the results of the above mentioned two determinations.

According to another aspect of the present invention, the first determination of the state of the object to be heated is made at least as to whether or not a cover is placed on the object to be heated.

According to a further aspect of the present invention, the second determination of the state of the object to be heated is made at least as to the quantity of the object to be heated.

According to a still further aspect of the present invention, the specified factors concerning the state of the object to be heated include a humidity change rate in the heating chamber after the early stage of heating operation.

According to a still further aspect of the present invention, the specified factors concerning the state of the object to be heated include a period of time required for a detected humidity level after the early stage of heating operation to attain a predetermined level set based on the first determination.

Therefore, a principal advantage of the present invention is that a state of an object to be heated can be determined appropriately and fine heating control can be performed since the first determination on the state of the object to be heated is made based on the humidity change rate at an early stage of heating operation and the second determination on the state of the object to be heated is made based on the specified factors in the subsequent heating operation.

Another advantage of the present invention is that an object to be heated covered with wrap can be appropriately heated since it is determined based on detection of a humidity change rate at an early stage of heating that the object to be heated is covered with wrap and the quantity of the object is determined by another detection of a humidity change rate at a higher humidity level.

A further advantage of the present invention is that a suitable pattern out of various heating control patterns can be accurately applied since heating control is performed based on humidity change rates at an early stage and subsequent stages of heating.

A still further advantage of the present invention is that food can be finished in the best state irrespective of the quantity of the food or whether or not a cover is placed thereon because a suitable heating course is selected and executed out of a plurality of heating courses in a cooking sequence for casserole or soup/stew based on not only a humidity change rate at an early stage of heating but also other factors such as a period required thereafter or humidity change rates at subsequent stages.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
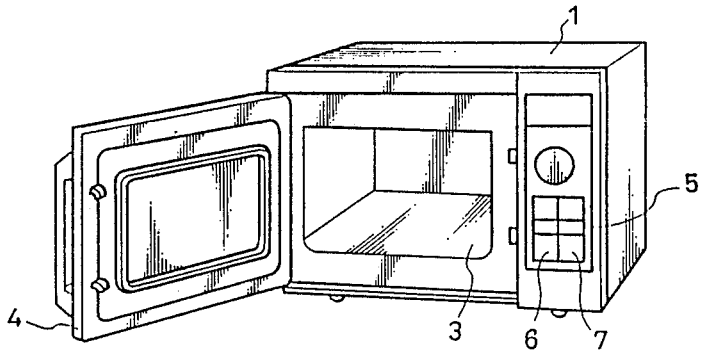
FIG. 1 is a perspective appearance view showing a microwave oven of an embodiment of the present invention.
Figure 2:
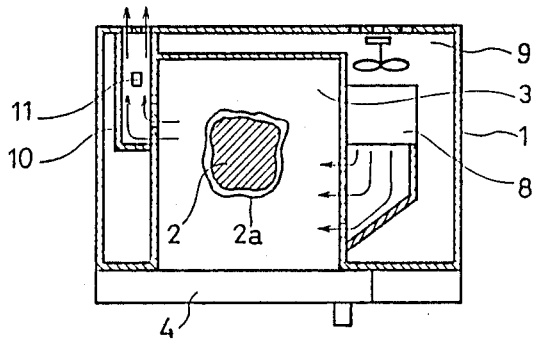
FIG. 2 is a sectional plan view of the microwave oven shown in FIG. 1.

FIG. 1 is a perspective appearance view showing a microwave oven of an embodiment of the present invention and FIG. 2 is a sectional plan view therof. Referring to FIGS. 1 and 2, a main body 1 of the microwave oven has a heating chamber 3 for containing food 2 to be heated. A door 4 for opening and closing a front opening of the heating chamber 3, and a keyboard 5 are provided on the front face of the main body 1. The keyboard 5 includes various keys such as a humidity key 6 for selecting humidity control heating and a start key 7.

On the other hand, the main body 1 contains a magnetron 8 as microwave supply means. Microwaves are supplied from the magnetron 8 into the heating chamber 3 through openings in a right side wall of the chamber 3 so that the food 2 is heated by microwaves. A fan 9 is provided at the back of the magnetron 8 so that the magnetron 8 is cooled by a cooling wind generated by the fan 9. The cooling wind enters thereafter the heating chamber 3 through the openings in the right side wall of the chamber 3 as shown by arrows in FIG. 2. Then, the cooling wind, together with the air in the heating chamber 3 containing vapor generated from the food 2 by microwave heating, enters an exhaust duct 10 through openings in the left side wall of the heating chamber 3 as shown by arrows in FIG. 2 and then it is discharged to outside from openings provided in the rear wall of the main body 1 through the exhaust duct 10. Further, a humidity sensor 11 is provided in the exhaust duct 10 to detect an absolute humidity of the environmental air passing through the exhaust duct 10, that is, an absolute humidity in the heating chamber 3.

Figure 3:
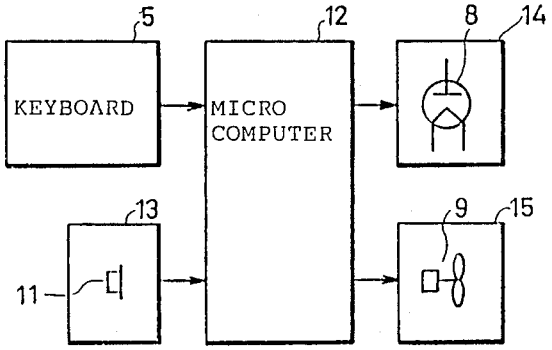
FIG. 3 is a schematic block diagram showing a control system of the microwave oven shown in FIGS. 1 and 2.

FIG. 3 is a schematic block diagram showing a control system of the microwave oven of the embodiment shown in FIGS. 1 and 2. Referring to FIG. 3, control of operation of the microwave oven is executed by a microcomputer 12 as a control portion. More specifically, the microcomputer 12 receives, as inputs, information on key operation on the keyboard 5 and humidity information from a sensor circuit 13 including the humidity sensor 11 shown in FIG. 2 and, based on the information thus received, the microcomputer 12 controls a magnetron drive circuit 14 including the magnetron 8 of FIG. 2 and a fan drive circuit 15 including the fan 9 of FIG. 2.

Figure 4:
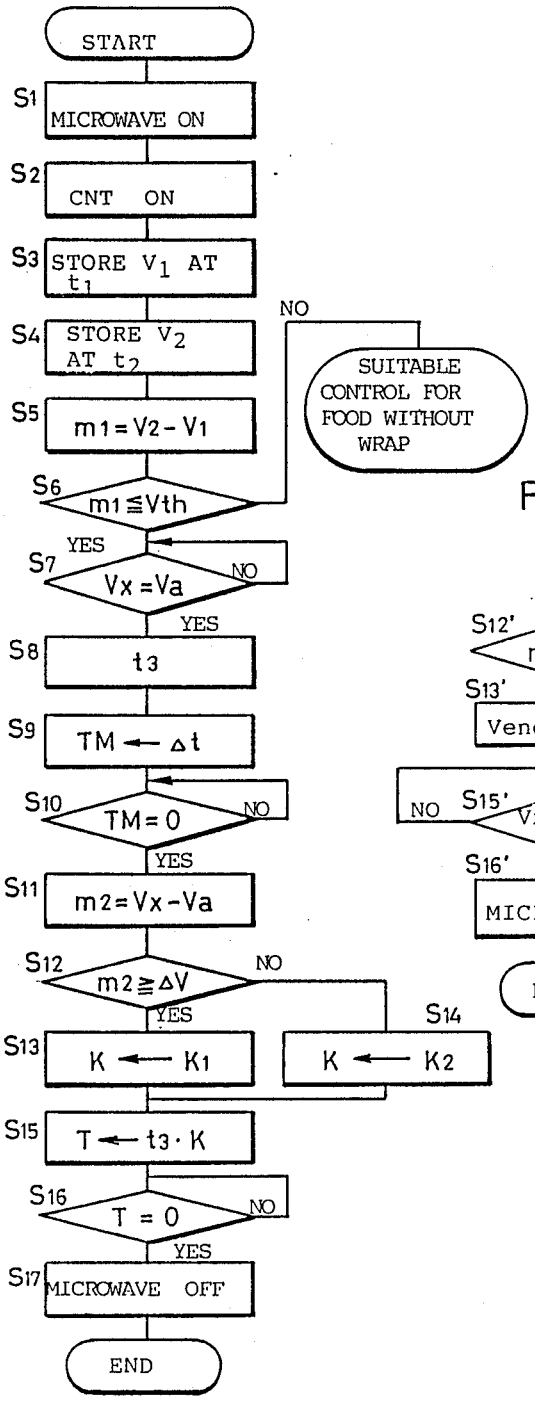
FIG. 4 is a flowchart showing a control program of the microcomputer shown in FIG. 3, according to a first embodiment of the invention.
Figure 5:
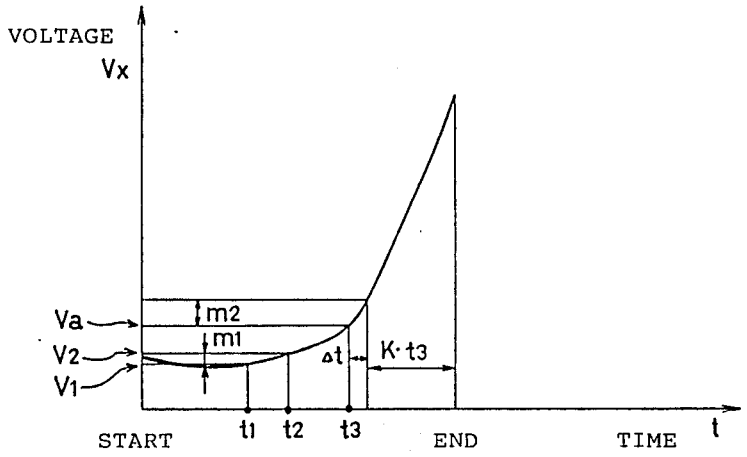
FIG. 5 is a graph showing a change with time in a detected absolute humidity during heating operation shown in FIG. 4.

FIG. 4 is a flowchart showing a first embodiment of a control program of the microcomputer 12 shown in FIG. 3. FIG. 5 is a graph showing a change, with respect to time, in an output of the humidity sensor 11, that is, a detected absolute humidity during the operation shown in FIG. 4. In FIG. 5, the abscissa represents time and the ordinate represents an output voltage of the humidity sensor 11.

Description is now made of heating operation of the microwave oven controlled based on humidity according to the first embodiment of the invention, with reference to FIGS. 4 and 5.

First, as shown in FIG. 2, food 2 covered with clear-plastic wrap 2*a* is placed in the heating chamber 3 of the microwave oven and the humidity key 6 on the keyboard 5 is operated. As a result, the program proceeds to the step S1. In the step S1, the microcomputer 12 starts driving of the magnetron drive circuit 14, whereby microwave heating of the food 2 is started. At the same time, the microcomputer 12 starts driving of the fan drive circuit 15, whereby the magnetron 8 is cooled. Then, the cooling wind from the fan 9 enters the heating chamber 3 through the openings of the right side wall of the heating chamber 3 and the wind, accompanied by the environmental air in the heating chamber 3, enters the exhaust duct 10 through the openings of the left side wall and is discharged to outside. Next, the program proceeds to the step S2 to start upward counting for determination of time by a counter CNT (not shown) included in the microcomputer 12. Then, the program proceeds to the step S3. In the step S3, the microcomputer 12 waits until a passage of first time $t_1$ at an early stage of the heating is determined by counting of the counter CNT. When the passage of the first time $t_1$ is determined by counting, a voltage $V_1$ corresponding to a humidity detected by the humidity sensor 11 at that time is stored in a storage device (not shown) in the microcomputer 12. In the step S4, the microcomputer 12 waits until a passage of second time $t_2$ ($t_2 > t_1$) at the early stage of heating is determined by counting of the counter CNT. When the passage of the second time $t_2$ is determined by counting, a voltage $V_2$ corresponding to a humidity detected by the humidity sensor at that time is stored in the storage device in the microcomputer 12. Then, the program proceeds to the step S5, in which the voltage $V_1$ is subtracted from the voltage $V_2$ to obtain a voltage value $m_1 = V_2 - V_1$. The value $m_1$ obtained by the subtraction represents a voltage corresponding to a change rate of the detected absolute humidity for a period from the first time $t_1$ to the second time $t_2$.

Next, in the step S6, it is determined whether or not the voltage value $m_1$ dependent on the humidity change rate, calculated in the step S5 is equal to or lower than a predetermined voltage value Vth. Since the times $t_1$ and $t_2$ are in the early stage of heating as described above, a quantity of vapor generated from the food 2 by microwave heating is still small and such vapor hardly leaks from the wrap 2*a*. Accordingly, the above mentioned voltages $V_1$ and $V_2$ are both low and they correspond to detected humidities having little difference. In consequence, it is determined in the step S6 that the voltage value $m_1$ corresponding to the humidity change rate in this case is equal to or lower than the predetermined voltage value Vth. In other words, such determination in the step S6 means detection of covering of the wrap 2*a* over the food 2 to be heated and then the program proceeds to the step S7.

If the food 2 is not covered with wrap, a humidity change in the heating chamber 3 due to generation of vapor from the food is detected as it is even if the quantity of the vapor generated from the food by microwave heating is small at the early stage of heating and, in such a case, a noticeable difference is exhibited between the detected humidities at the first time $t_1$ and the second time $t_2$. Thus, a considerable difference is also exhibited between the voltages $V_1$ and $V_2$ and, accordingly, it is determined that the voltage value $m_1$ is larger than the predetermined voltage value Vth. Such determination means that the food 2 to be heated is not covered with wrap, and then the program proceeds to the steps for suitable humidity control heating for the food not covered with wrap.

On the other hand, if it is determined in the step S6 that the food 2 is covered with the wrap 2*a*, the program proceeds to the step S7 to determine whether a voltage Vx corresponding to a detected humidity attains a voltage Va corresponding to a predetermined high humidity level. The program stays in the step S7 until it is determined that the voltage Vx attains the voltage Va. During this period, microwave heating of the food 2 progresses to a considerable extent and a large quantity of vapor begins to be generated from the food 2. As a result, a large quantity of vapor begins to leak rapidly through gaps at the borders of the wrap 2*a* and the voltage Vx corresponding to the detected humidity attains the voltage Va corresponding to the predetermined high humidity level. Then, the program proceeds to the step S8 so that time $t_3$ determined till then by counting of the counter CNT is stored in the storage device of the microcomputer 12. After the time $t_3$ has been stored, counting operation of the counter CNT is stopped and the content of the counter CNT is cleared.

Next, in the step S9, a predetermined time $\Delta t$ is set in a timer TM (not shown) included in the microcomputer 12 and the timer TM starts downward counting for determination of the time $\Delta t$. Subsequently, the program proceeds to the step S10 for determining whether the content of the timer TM is 0 or not. The program stays in the step S10 until detection of 0. When it is determined in the step S10 that the content of the timer TM is 0, the program proceeds to the step S11. In the step S11, the voltage Vx corresponding to the predetermined high humidity level at the time of determination of 0 by the timer TM is detected and the above mentioned predetermined voltage Va is subtracted from the voltage Vx so that a voltage value $m_2$ is obtained. In other words, the voltage value $m_2$ is a voltage value corresponding to a change rate of a detected humidity for the above described predetermined time $\Delta t$.

Next, in the step S12, it is determined whether or not the voltage value $m_2$ corresponding to the humidity change rate calculated in the step S11 is equal to or larger than a predetermined voltage value $\Delta V$. If it is determined that the voltage value $m_2$ is equal to or larger than $\Delta V$, the program proceeds to the step S13 to set an appropriate coefficient $K_1$ corresponding to the voltage value $m_2$ equal to or larger than $\Delta V$ in a coefficient register K (not shown) in the microcomputer 12. On the other hands, if it is determined that the voltage value $m_2$ is smaller than $\Delta V$, the program proceeds to the step S14 to set, in the coefficient register K, an appropriate coefficient $K_2$ corresponding to the voltage value $m_2$ smaller than $\Delta V$.

Subsequently, in the step S15, the time $t_3$ stored in the storage device in the microcomputer 12 is multiplied by the coefficient set in the coefficient register K so that time $t_3 \cdot K$ (K being $K_1$ or $K_2$) for after-heating is obtained, and this time $t_3 \cdot K$ is set in a timer T (not shown) included in the microcomputer 12. Then, the timer T starts downward counting for determination of passage of the time $t_3 \cdot K$. Thus, since the coefficient K set in the coefficient register K is a value to be suited for the voltage value $m_2$ corresponding to the change rate of the detected humidity, the time for after-heating set in the timer T is suited for the voltage value $m_2$.

Next, the program proceeds to the step S16 for determining whether or not the content of the timer T becomes 0 as a result of the downward counting, and the program stays in the step S16 until such detection of 0. When it is determined in the step S16 that the content of the timer T is 0, the program proceeds to the step S17. In the step S17, the microcomputer 12 stops the driving of the magnetron drive circuit 14 and the fan drive circuit 15, thereby to terminate, with good result, heating of the food covered with the wrap 2a based on appropriate humidity control.

Although after-heating is applied by determination of the after-heating time $t_3 \cdot K$ in the above described embodiment, after-heating may be applied by setting a voltage corresponding to a suitable humidity of finish.

Figure 6:
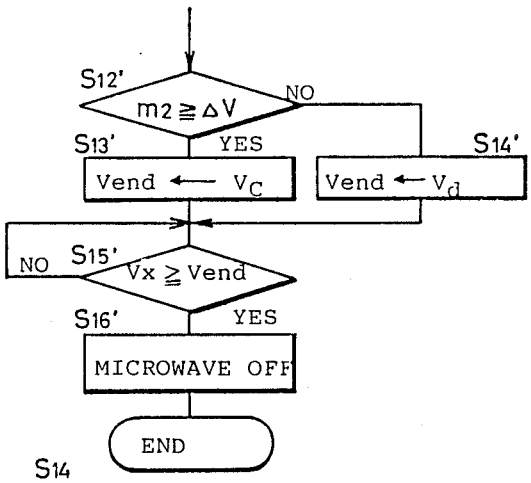
FIG. 6 is a flowchart showing a variant of the first embodiment shown in FIG. 4.
Figure 7:
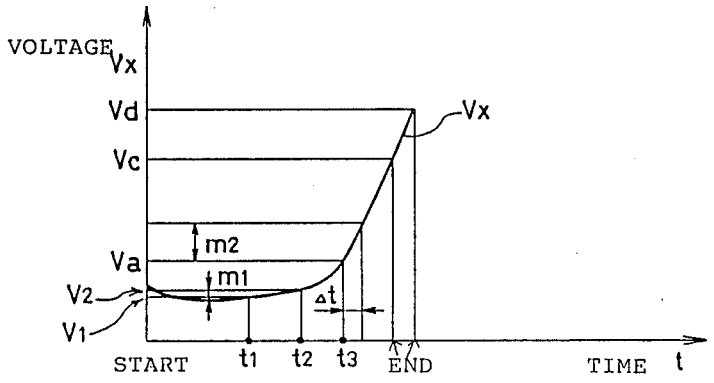
FIG. 7 is a graph showing a change with time in a detected absolute humidity during heating operation shown in FIG. 6.

FIG. 6 is a flowchart showing a variant of the above described first embodiment, in which after-heating is applied by setting of a voltage, not by setting of time. Since the steps S1 to S11 are the same as those in the flowchart of FIG. 4, illustration and description thereof are omitted. The steps S12' to S16' constitute characteristic portions of this variant corresponding to the steps S12 to S17 of FIG. 4. FIG. 7 is a graph showing a change with time in a detected absolute humidity during operation shown in FIG. 6. In FIG. 7, the abscissa represents time and the ordinate represents an output voltage of the humidity sensor 11.

first in the step S12', it is determined whether or not the voltage value $m_2$ corresponding to the humidity change rate calculated in the above described step S11 shown in FIG. 4 is equal to or larger than the predetermined voltage value $\Delta V$. If it is determined that the voltage value $m_2$ is equal to or larger than $\Delta V$, the program proceeds to the step S13', so that a voltage Vc dependent on the voltage value $m_2$, corresponding to a suitable humidity of finish after the after-heating is set in a finishing register Vend (not shown) in the microcomputer 12. On the other hand, if it is determined that the voltage value is smaller than $\Delta V$, the program proceeds to the step S14', so that a voltage Vd dependent on the voltage value $m_2$, corresponding to a suitable humidity of finish after the after-heating is set in the finishing register Vend.

Subsequently, the program proceeds to the step S15' for determining whether or not the voltage Vx dependent on a detected present humidity attains the voltage Vc or Vd in the finishing register Vend, and the program stays in the step S15' until it is determined that the voltage Vx attains the voltage Vc or Vd. When it is determined in the step S15' that the voltage Vx attains the voltage set in the register Vend, the program proceeds to the step S16'. In the step S16', the microcomputer 12 stops the driving of the magnetron drive circuit 14 and that of the fan drive circuit 15, thereby to terminate heating of the food 2 covered with the wrap 2a based on appropriate humidity control.

As described above, according to the first embodiment of the invention, a humidity change rate at a low humidity level is detected and if the change rate is smaller than a predetermined value, that is, if the food is covered with wrap, a humidity change rate at a higher humidity level is detected, so that after-heating dependent on the detected change rate is applied. Consequently, even if the food to be heated is covered with wrap, heating control based on detected humidities can be appropriately performed.

FIGS. 8 to 11 are graphs for explaining various heating control patterns according to a second embodiment of a control program of the microcomputer 12 shown in FIG. 3, more particularly, graphs respectively showing changes with time in detected absolute humidity. In each of those figures, the abscissa represents time and the ordinate represents a detected absolute humidity.

In the following, heating control patterns according to the second embodiment of the invention are classified as four patterns A1, A2, B1 and B2 and those patterns are described hereinafter with reference to the corresponding graphs.

Heating control pattern A1

Figure 8:
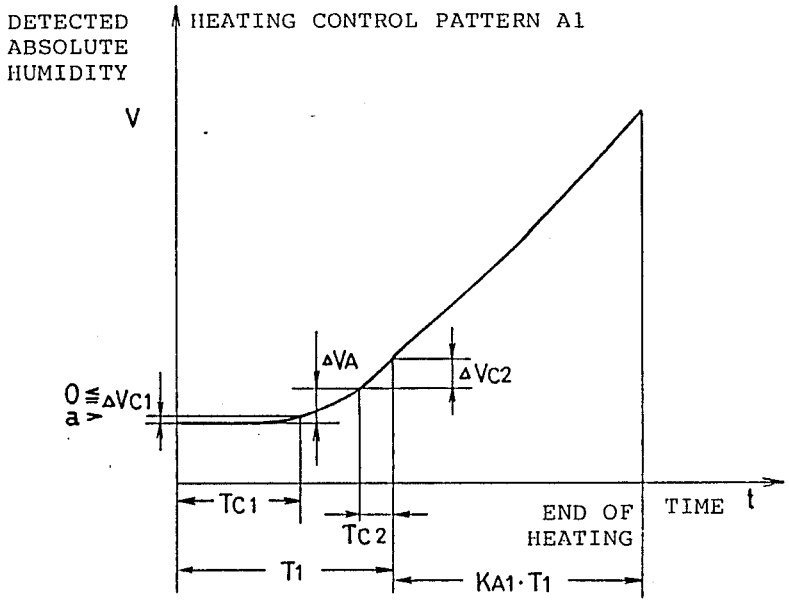
FIG. 8 is a graph for explaining a heating control pattern A1 according to a second embodiment of the present invention.

FIG. 8 represents the heating control pattern A1. The heating control pattern A1 is applied in cases where food is covered with a lid or wrap to permit little gaps between a vessel containing the food and the lid or wrap, with the quantity of the food being large.

First, evaluation is performed to obtain a change rate $\Delta V_{C1}$ of a detected absolute humidity V at the beginning of heating until an elapse of time $T_{C1}$ (one minute) after the start of heating. In this case, since the food is covered with a lid or wrap to cause little gaps with the container, little vapor is emitted in the heating chamber 3 and the change rate $\Delta V_{C1}$ is small. Thus, it is determined that the change rate $\Delta V_{C1}$ is in the range from 0 to less than a (1 g/m$^3$). When such determination is made, a first heating condition, that is, an absolute humidity difference $\Delta V_A$ (6 g/m$^3$) is determined.

Subsequently, as microwave heating of the food progresses, pressure in the vessel increases and vapor begins to be emitted to the heating chamber 3 from small gaps although the vessel is covered by the lid or wrap. Then, the change rate of the detected absolute humidity V during a period from the start of heating to the present point attains the absolute humidity difference $\Delta V_A$ as the above mentioned first heating condition. At that time, the detected absolute humidity V directly depends on the quantity of vapor generated from the food, without being affected by the lid or wrap.

Then, evaluation is performed to obtain a change rate $\Delta V_{C2}$ of the detected absolute humidity V in a period from the time when the change rate of the detected absolute humidity V attains the first heating condition $V_A$ until an elapse of the time $T_{C2}$ (15 seconds). In this case, since the quantity of the food is large, heating progresses slowly and emission of vapor from the food is slow. Accordingly, the change rate $\Delta V_{C2}$ is small and it is determined to be less than $\alpha$ (6 g/m$^3$). When such determination is made, a second heating condition, that is, a relatively large coefficient $K_{A1}$ (1.2) is determined.

After that, heating is performed for a period $K_{A1} \cdot T_1$ obtained by multiplication of time $T_1$ required from the start of heating until the passage of the time $T_{C2}$ by the large coefficient $K_{A1}$ as the second heating condition.

The heating period $K_{A1} \cdot T_1$ becomes long according to the large coefficient $K_{A1}$ and it is suited for heating of a large quantity of food. After the heating period $K_{A1} \cdot T_1$ has passed, the heating control pattern A1 for the case where the large quantity of food is covered with the lid or wrap permitting little gaps between the container and the lid or wrap is terminated with good result.

Heating control pattern A2

Figure 9:
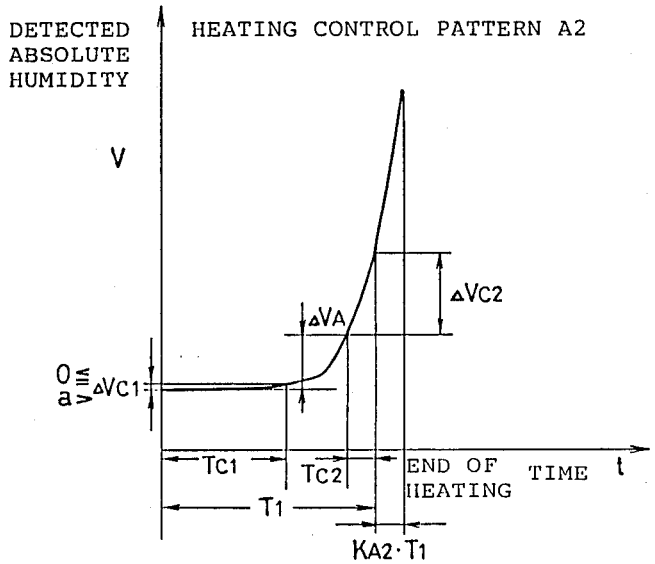
FIG. 9 is a graph for explaining a heating control pattern A2 according to the second embodiment of the present invention.

FIG. 9 represents a heating control pattern A2. The heating control pattern A2 is applied in cases where food contained in a vessel is covered with a lid or wrap permitting little gaps between the vessel and the lid or wrap, with the quantity of the food being small. First, control for evaluating a change rate $\Delta V_{C2}$ of a detected absolute humidity V until time $T_{C2}$ after the start of heating is performed in the same manner as in the above described heating control pattern A1. In this heating control pattern A2, since the quantity of the food is small, heating progresses fast and vapor is emitted from the food rapidly. Accordingly, the change rate $\Delta V_{C2}$ is large and it is determined that the change rate $\Delta V_{C2}$ is $\alpha$ (6 g/m$^3$) or more. When such determination is made, a second heating condition, that is, a relatively small coefficient $K_{A2}$ (0.1) is determined.

Subsequently, heating is applied for a period $K_{A2} \cdot T_1$ obtained by multiplication of time $T_1$ required until the passage of time $T_{C2}$ from the start of heating by the small coefficient $K_{A2}$ as the second heating condition. The heating period $K_{A2} \cdot T_1$ becomes short according to the small coefficient $K_{A2}$ and it is suited for heating of a small quantity of food. After the period $K_{A2} \cdot T_1$ has passed, the heating control pattern A2 for the case where the small quantity of food contained in the vessel is covered with the lid or wrap to permit little gaps between the vessel and the lid or wrap is terminated with good result.

Heating control pattern B1

Figure 10:
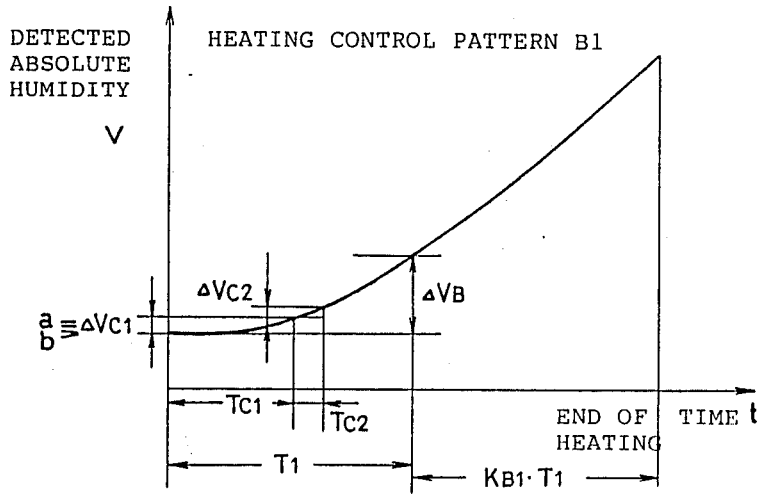
FIG. 10 is a graph for explaining a heating control pattern B1 according to the second embodiment of the present invention.

FIG. 10 represents a heating control pattern B1. The heating control pattern B1 is applied in cases where a paper cover is placed over food to permit gaps to some extent between a vessel containing the food and the cover, with the quantity of the food being large.

First, evaluation is performed to obtain a change rate $\Delta V_{C1}$ of a detected absolute humidity V at an early stage of heating until the passage of time $T_{C1}$ after the start of heating. In this case, since the paper cover is placed on the food to allow some gaps between the vessel and the cover, a certain amount of vapor is emitted in the heating chamber 3 and the change rate $\Delta V_{C1}$ is relatively large. Thus, it is determined that the change rate $\Delta V_{C1}$ is in the range from a (1 g/m$^3$) to less than b (4 g/m$^3$). When such determination is made, a first heating condition, that is, $\Delta V_B$ (8 g/m$^3$) is determined.

Subsequently, as microwave heating of the food progresses, the detected absolute humidity V increases according to the quantity of vapor emitted from the food into the heating chamber 3, without being influenced by the paper cover, because of the gaps to some extent between the vessel and the paper cover.

Then, evaluation is performed to obtain a change rate $\Delta V_{C2}$ of the detected absolute humidity V in a period from the passage of time $T_{C1}$ to the passage of time $T_{C2}$. In this case, since the quantity of the food is large, heating progresses slowly and emission of vapor from the food is slow. Accordingly, the change rate $\Delta V_{C2}$ is small and it is determined to be smaller than $\beta$ (2 g/m$^3$). When such determination is made, a second heating condition, that is, a relatively large coefficient $K_{B1}$ (1.5) is determined.

When heating further progresses and the change rate of the detected absolute humidity V from the start of heating to the present time attains the absolute humidity difference $\Delta V_B$ as the above mentioned first heating condition, heating is further performed for a period $K_{B1} \cdot T_1$ obtained by multiplication of the time $T_1$ required till then by the large coefficient $K_{B1}$ as the second heating condition. The heating period $K_{B1} \cdot T_1$ becomes long according to the large coefficient $K_{B1}$ and it is suited for heating of a large quantity of food. After the heating period $K_{B1} \cdot T_1$ has passed, the heating control pattern B1 for the case where the paper cover is placed over the large quantity of food to permit gaps to some extent between the cover and the vessel is terminated with good result.

Heating control pattern B2

Figure 11:
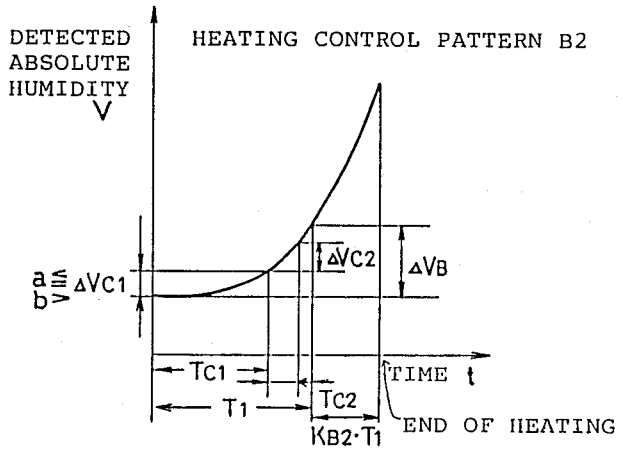
FIG. 11 is a graph for explaining a heating control pattern B2 according to the second embodiment of the present invention.

FIG. 11 represents a heating control pattern B2. The heating control pattern B2 is applied in cases where a paper cover is placed on food to permit gaps to some extent between a vessel containing the food and the cover, with the quantity of the food being small.

First, control for obtaining a change rate $\Delta V_{C2}$ of a detected absolute humidity V in a period from the passage of time $T_{C1}$ to the passage of time $T_{C2}$ is performed in the same manner as in the above described heating control pattern B1. In the heating control pattern B2, since the quantity of the food is small, heating progresses fast and the vapor is emitted from the food rapidly. Accordingly, the change rate $\Delta V_{C2}$ is large and it is determined to be $\beta$ (2 g/m$^3$) or more. When such determination is made, a second heating condition, that is, a relatively small coefficient $K_{B2}$ (0.4) is determined.

When the change rate of the detected absolute humidity V from the start of heating to the present time attains the absolute humidity difference $\Delta V_B$ as the first heating condition, heating is further performed for a period $K_{B2} \cdot T_1$ obtained by multiplication of the time $T_1$ required till then by the small coefficient $K_{B2}$ as the second heating condition. The heating period $K_{B2} \cdot T_1$ is short dependent on the small coefficient $K_{B2}$ and it is suited for heating of a small quantity of food. After the passage of the heating period $K_{B2} \cdot T_1$, the heating control pattern B2 for the case where the paper cover is placed on the small quantity of food to permit the gaps to some extent between the vessel and the cover is terminated with good result.

As described above, according to the heating control patterns A1, A2, B1 and B2, the first detection of the humidity change rate at an early stage of heating and the second detection of the humidity change rate thereafter are made and thus fine heating control can be performed.

Figure 12:
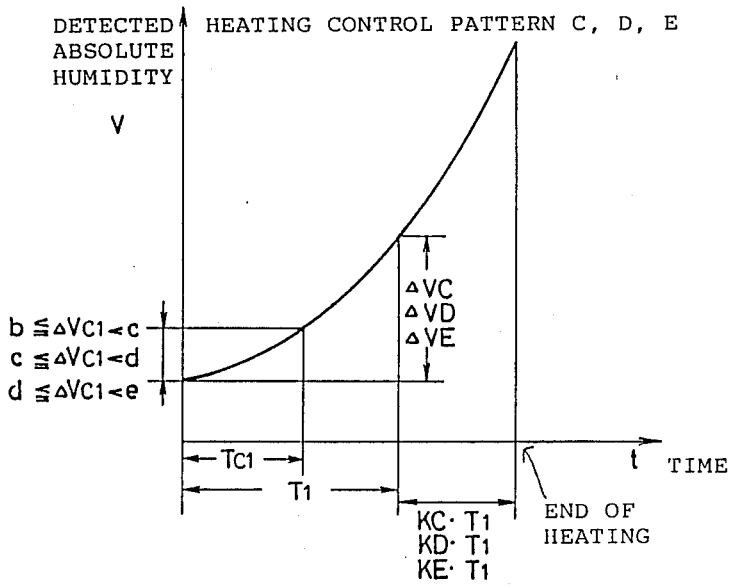
FIG. 12 is a graph representing heating control patterns C, D and E according to the second embodiment of the present invention.
Figure 13:
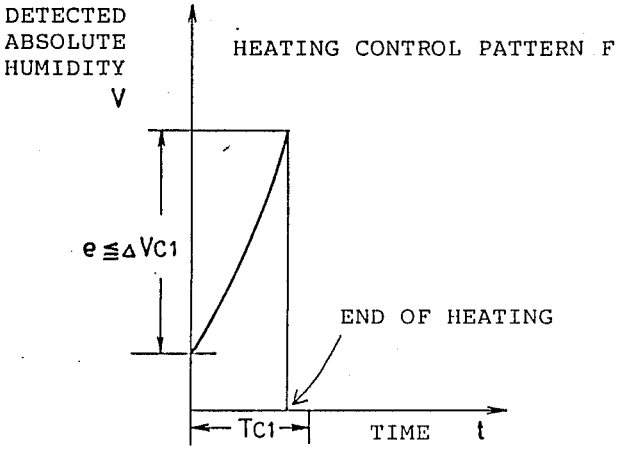
FIG. 13 is a graph for explaining a heating control pattern F according to the second embodiment of the invention.

FIGS. 12 and 13 are graphs for explaining the heating control performed in other situations than in the above described heating control patterns A1, A2, B1 and B2 according to the above described second embodiment. Such heating control patterns are classified as patterns C, D, E and F in the following and those patterns will be described with reference to the corresponding graphs.

Heating control pattern C

FIG. 12 shows heating control patterns C, D and E. First, the heating control pattern C is executed in cases where any cover such as a lid is not placed on a vessel containing food, with the quantity of the food being large.

First, evaluation is performed to obtain a change rate $\Delta V_{C1}$ of a detected absolute humidity V at an early stage of heating until the passage of time $T_{C1}$ after the start of heating. In this case, since there is no cover on the vessel, vapor generated from the food is freely emitted in the heating chamber 3. However, since the quantity of the food is large, heating progresses slowly and the emission of the vapor from the food is slow. Thus, the change rate $\Delta V_{C1}$ is determined to be in the range from b (4 g/m$^3$) to less than c (10 g/m$^3$). When such determination is made, an absolute humidity difference $\Delta V_C$ (16 g/m$^3$) and a coefficient $K_C$ (0.8) are determined.

Subsequently, when the microwave heating progresses and the change rate of the detected absolute humidity V from the start of heating to the present time attains the absolute humidity difference $\Delta V_C$, heating is further performed for a period $K_C \cdot T_1$ obtained by multiplication of the time $T_1$ required till then by the above mentioned coefficient $K_C$. After the heating period $K_C \cdot T_1$ has passed, the heating control pattern C for the case where any cover such as a lid is not placed on the vessel containing the large quantity of food is terminated with good result.

Heating control pattern D

The heating control pattern D is executed in cases where any cover such as a lid is not placed on a vessel containing food, with the quantity of the food being smaller than that in the above described pattern C.

In this case, emission of vapor from the food is faster than in the pattern C and thus it is determined that the change rate $\Delta V_{C1}$ is in the range from c (10 g/m$^3$) to less than d (16 g/m$^3$). When such determination is made, an absolute humidity difference $\Delta V_D$ (16 g/m$^3$) and a coefficient $K_D$ (0.5) are determined in place of the above mentioned absolute humidity difference $\Delta V_C$ and coefficient $K_C$.

Heating control pattern E

The heating control pattern E is executed in cases where any cover such as a lid is not placed on a vessel containing food, with the quantity of the food being smaller than in the above described pattern D.

In this case, emission of vapor from the food is faster than in the above described pattern D and thus it is determined that the change rate $\Delta V_{C1}$ is in the range from d (16 g/m$^3$) to less than e (22 g/m$^3$). When such determination is made, an absolute humidity difference $\Delta V_E$ (24 g/m$^3$) and a coefficient $K_E$ (0.5) are determined in place of the above mentioned $\Delta V_D$ and $K_D$.

Heating control pattern F

FIG. 13 represents the heating control pattern F. The heating control pattern F is executed in cases where any cover such as a lid is not placed on a vessel containing food, with the quantity of the food being very small.

In this case, since the quantity of the food is very small, heating progresses fast and emission of vapor from the food is very rapid. More specifically, the food will be rapidly heated to an excessively high temperature before the passage of time $T_{C1}$ after the start of heating, which involves a danger of firing. Therefore, in this case, even before the passage of time $T_{C1}$, heating is terminated when the change rate $\Delta V_{C1}$ attains a high humidity level e (22 g/m$^3$). Thus, the food can be reliably prevented from being rapidly heated to an excessively high temperature and thus the danger of firing can be removed.

FIGS. 14A to 14D are flowcharts showing control programs of the microcomputer 12 for executing the above described heating control patterns A1, A2, B1, B2, C, D, E and F.

Referring to FIGS. 8 to 14D, heating operation of the microwave oven based on humidity control according to the second embodiment of the invention will be described for each heating control pattern.

Heating control pattern A1

First, food 2 to be heated is placed in the heating chamber 3 of the microwave oven and the humidity key 6 on the keyboard 5 is operated. As a result, the program proceeds to the step S101. In the step S101, the microcomputer 12 starts operation of the magnetron drive circuit 14 to start microwave heating of the food 2. At the same time, the microcomputer 12 starts operation of the fan drive circuit 15 to cool the magnetron 8. Then, the cooling wind enters the heating chamber 3 through the openings of the right side wall of the heating chamber 3 and it is drawn, together with the environmental air in the heating chamber 3, into the exhaust duct 10 through the openings of the left side wall and is discharged to outside.

It is determined in a circulating manner whether or not the change rate $\Delta V_{C1}$ of the detected absolute humidity V in the period from the start of heating to the present time is equal to or larger than e (in the step S102) and whether or not the elapsed time after the start of heating attains $T_{C1}$ (in the step S103). When the elapse of the time $T_{C1}$ is determined in the step S103, the change rate $\Delta V_{C1}$ of the detected absolute humidity V during the time $T_{C1}$ is evaluated and it is determined that the change rate $\Delta V_{C1}$ is in the range from 0 to less than a (in the step S104).

Then, in the step A1 of a routine A (in FIG. 14B), an absolute humidity difference $\Delta V_A$ is determined and it is determined in the step A2 that the change rate of the detected absolute humidity attains $\Delta V_A$. When such determination is made, it is determined in the subsequent step A3 whether the elapsed time after the detection of $\Delta V_A$ attains $T_{C2}$ or not. When the elapse of the time $T_{C2}$ is determined, the change rate $\Delta V_{C2}$ of the detected absolute humidity V during the time $T_{C2}$ is evaluated and it is determined that the change rate $\Delta V_{C2}$ is smaller than $\alpha$ (in the step A4).

Then, in the step A5, the coefficient $K_{A1}$ is determined and heating is further performed for the period $K_{A1} \cdot T_1$ obtained by multiplication of the heating time $T_1$ required till then by the coefficient $K_{A1}$.

Heating control pattern A2

Operation in the heating control pattern A2 is the same as the operation of the heating control pattern A1 except for the below described points. In the step A4 of the routine A (in FIG. 14B), it is determined that the change rate $\Delta V_{C2}$ of the detected absolute humidity V during the time $T_{C2}$ is equal to or larger than $\alpha$.

It is determined in the step A6 that the coefficient $K_{A2}$ is determined and heating is further performed for the period $K_{A2} \cdot T_1$ obtained by multiplication of the heating time $T_1$ required till then by the coefficient $K_{A2}$.

Heating control pattern B1

The steps S101 to S103 in this heating control pattern B1 are the same as those in the heating control pattern A1. According to the heating control pattern B1, it is determined in the step S104 that the change rate $\Delta V_{C1}$ is not in the range from 0 to less than a and it is determined in the step S105 that the change rate $\Delta V_{C1}$ is in the range from a to less than b.

Then, in the step B1 in a routine B (in FIG. 14C), the absolute humidity difference $\Delta V_B$ is determined and in the step B2, it is determined whether the time $T_{C2}$ *has further passed after the elapse of the time* $T_{C1}$. When it is determined that the time $T_{C2}$ has passed, the change rate $\Delta V_{C2}$ of the detected absolute humidity V during the time $T_{C2}$ is obtained in the step B3. When it is determined in the step B3 that the change rate $\Delta V_{C2}$ thus obtained is smaller than $\beta$, the coefficient $K_{B1}$ is determined in the subsequent step B4. Then, in the step B5, it is determined that the change rate of the detected absolute humidity V in the period from the start of heating to the present time attains the above stated absolute humidity difference $\Delta V_B$ and when such determination is made, heating is further performed in the step B6 for the period $K_{B1} \cdot T_1$ obtained by multiplication of the heating time $T_1$ required till then by the coefficient $K_{B1}$.

Heating control pattern B2

Figure 14A:
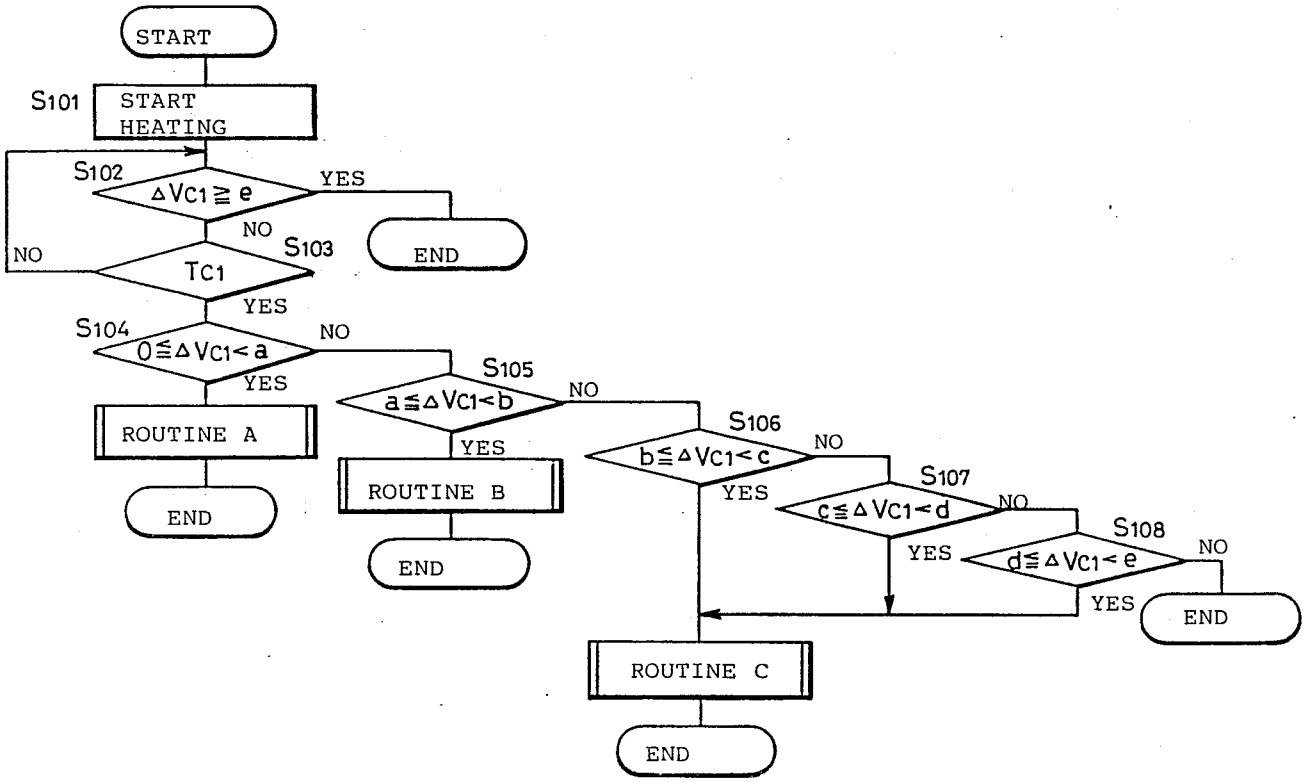
FIGS. 14A to 14D are flowcharts showing a control program of a microcomputer 12 according to the second embodiment of the invention.
Figure 14B:
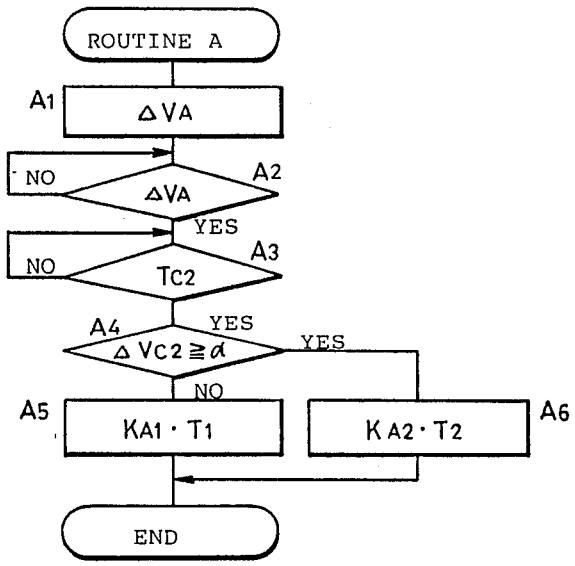
Figure 14C:
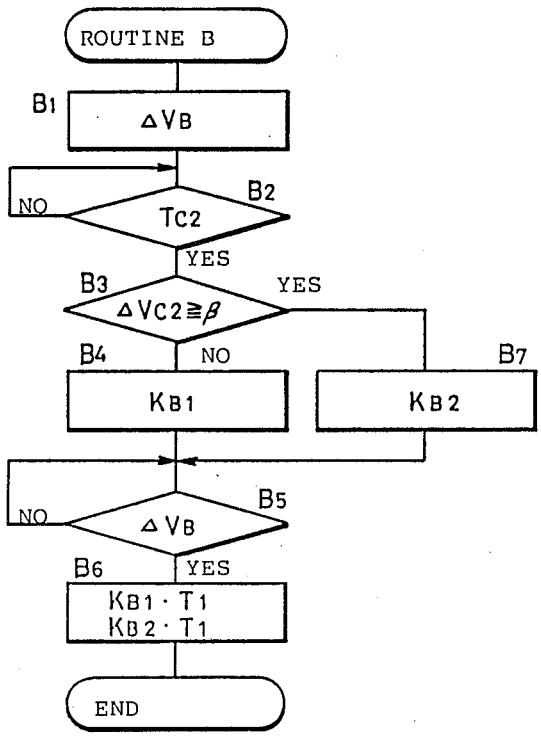

Operation in the heating control pattern B2 is the same as the operation in the heating control pattern B1 except for the below described points. In the step B3 of the routine B (as shown in FIG. 14C), it is determined that the change rate $\Delta V_{C2}$ of the detected absolute humidity V during the time $T_{C2}$ is equal to or larger than $\beta$.

Then, in the step B7, the coefficient $K_{B2}$ is determined and in the subsequent step B6, heating is further performed for the period $K_{B2} \cdot T_1$.

Heating control pattern C

The steps S101 to S104 in the heating control pattern C are the same as those in the heating control pattern B1. According to this heating control pattern C, it is determined in the step S105 that the change rate $\Delta V_{C1}$ is not in the range from a to less than b, and it is determined in the step S106 that the change rate $\Delta V_{C1}$ is in the range from b to less than c.

Figure 14D:
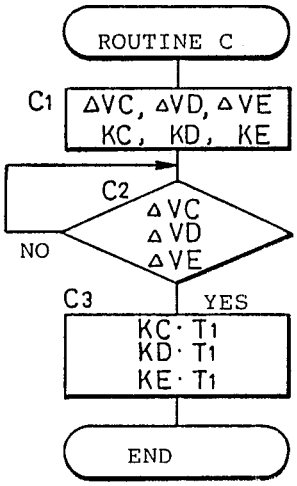

Then, in the step C1 of a routine C (as shown in FIG. 14D), the absolute humidity difference $\Delta V_C$ and the coefficient $K_C$ are determined and in the subsequent step C2, it is determined whether the change rate of the detected absolute humidity V till then attains the absolute humidity difference $\Delta V_C$ or not. When it is determined that the change rate attains $\Delta V_C$, heating is further performed in the step C3 for the period $K_C \cdot T_1$ obtained by multiplication of the heating time $T_1$ required till then by the coefficient $K_C$.

Heating control pattern D

The steps S101 to S105 in the heating control pattern D are the same as those in the heating control pattern C. According to this heating control pattern D, it is determined in the step S106 that the change rate $\Delta V_{C1}$ is not in the range from b to less than c and it is determined in the step S107 that the change rate $\Delta V_{C1}$ is in the range from c to less than d.

Then, in the step C1 of the routine C, the absolute humidity difference $\Delta V_D$ and the coefficient $K_D$ are determined in place of $\Delta V_C$ and $K_C$ and in the subsequent step C2, it is determined that the change rate of the detected absolute humidity V till then attains the absolute humidity difference $\Delta V_D$. When such determination is made, heating is further performed in the step C3 for the period $K_D \cdot T_1$ obtained by multiplication of the heating time $T_1$ elapsed till then by the coefficient $K_D$.

Heating control pattern E

The steps S101 to S106 in the heating control pattern E are the same as those in the heating control pattern D. According to the heating control pattern E, it is determined in the step S107 that the change rate $\Delta V_{C1}$ is not in the range from c to less than d and it is determined in the step S108 that the change rate $\Delta V_{C1}$ is in the range from d to less than e.

Then, in the step C1 of the routine C, an absolute humidity difference $\Delta V_E$ and a coefficient $K_E$ are determined in place of $\Delta V_D$ and $K_D$ and in the subsequent step C2, it is determined that the change rate of the detected absolute humidity V till then attains the absolute humidity difference $\Delta V_E$. When such determination is made, heating is further performed in the step C3 for a period $K_E \cdot T_1$ obtained by multiplication of the heating time $T_1$ till then by the coefficient $K_E$.

Heating control pattern F

According to the heating control pattern F, when the change rate $\Delta V_{C1}$ is determined to be e or more in the step S102 during circulation of the program in the steps S102 and S103, the program exits from the above mentioned circulation to terminate the heating.

Although the above described embodiment is adapted to terminate heating when the food is heated unnecessarily and rapidly to a predetermined humidity level at the early stage of heating, that is, before the elapse of the time $T_{C1}$, the present invention may be adapted to have individual safety absolute humidity levels other than the above mentioned humidity level thereby to terminate heating for safety when a detected absolute humidity attains the corresponding safety absolute humidity level even before the elapse of the corresponding one of the heating periods $K_{A1} \cdot T_1$, $K_{A2} \cdot T_1$, $K_{B1} \cdot T_1$, $K_{B2} \cdot T_1$, $K_C \cdot T_1$, $K_D \cdot T_1$ and $K_E \cdot T_1$. Such adaptation can be effectively applied if any of the above mentioned heating periods is prolonged for some cause or other.

Further, although the heating output is constant (maximum) in the above described embodiment, the heating output may be changed suitably during the heating process, whereby a better condition of finish of the food can be obtained. For example, after heating is effected with the maximum output at first, the outputs in the heating periods $K_{A1} \cdot T_1$, $K_{A2} \cdot T_1$, $K_{B1} \cdot T_1$, $K_{B2} \cdot T_1$, $K_C \cdot T_1$, $K_D \cdot T_1$ and $K_E \cdot T_1$ may be changed to 80% of the maximum output.

Thus, according to the second embodiment of the invention, since heating control is performed based on the humidity change rate at the early stage of heating and the humidity change rate thereafter, an appropriate heating control pattern can be accurately selected and performed out of different heating control patterns and detection of an excessive rapid heating during the heating process makes it possible to prevent firing and thus to improve safety of the microwave oven.

Figure 15:
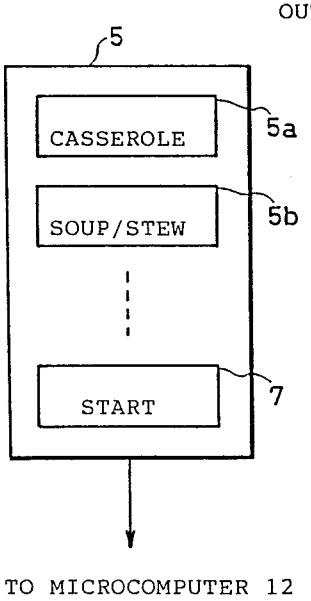
FIG. 15 is a detailed illustration of a keyboard 5 of a microwave oven according to a third embodiment of the invention.

FIG. 15 is a detailed view of a keyboard 5 provided on the front face of a microwave oven according to a third embodiment of the invention. The third embodiment of the invention comprises a first cooking sequence for making casserole and a second cooking sequence for making soup or stew. Accordingly, the keyboard 5 of FIG. 15 includes a casserole key 5*a* for selecting the first cooking sequence, a soup/stew key 5*b* for selecting the second cooking sequence and a start key 7 for instructing a start of heating.

Figure 16:
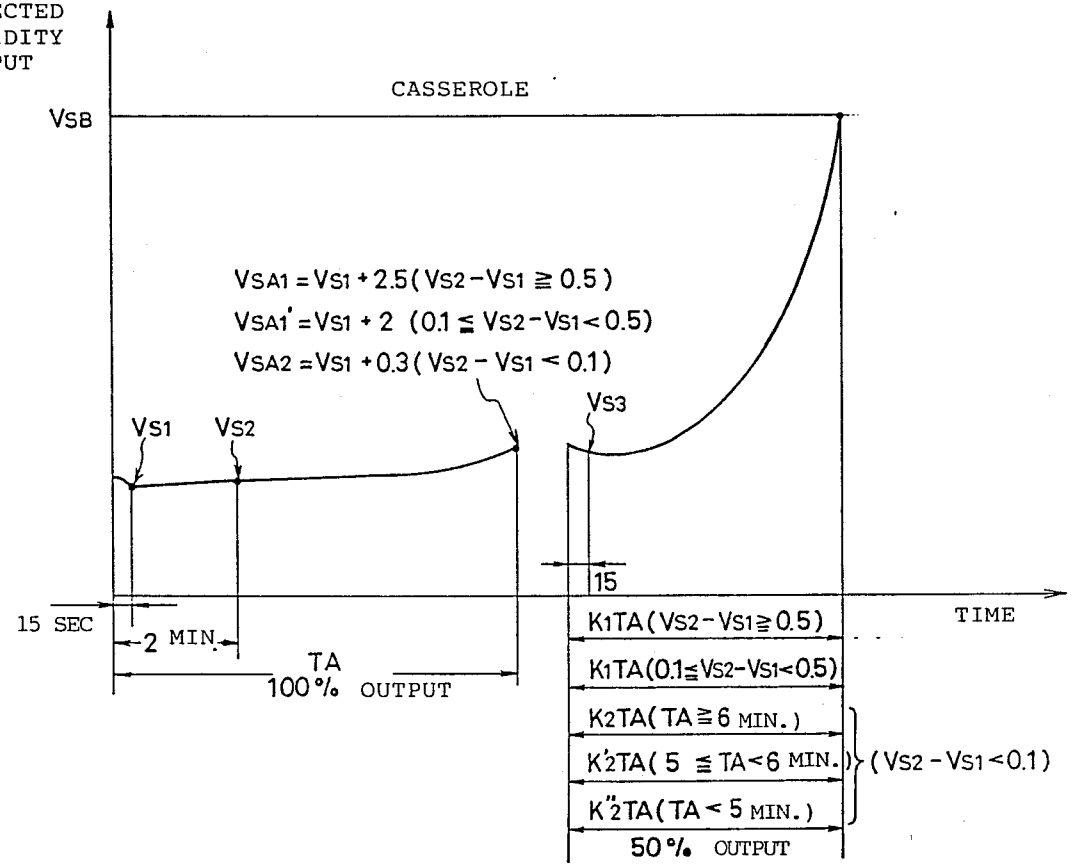
FIG. 16 is a graph for explaining a first cooking sequence according to the third embodiment of the invention.

FIG. 16 is a graph for explaining the first cooking sequence for making casserole, more particularly a graph showing change with time in an output of the humidity sensor 11, that is, a detected absolute humidity. In FIG. 16, the abscissa represents time and the ordinate represents an output voltage of the humidity sensor 11.

In the following, the first cooking sequence for making casserole will be described with reference to the graph of FIG. 16.

First, the casserole key 5*a* of the keyboard 5 is pressed to select the first cooking sequence and the start key 7 is pressed to instruct a start of heating. Thus, microwave heating with an output of 100% is started. Next, a humidity increase rate at an early stage of heating is evaluated. More specifically, a voltage $V_{S1}$ corresponding to an absolute humidity detected after 15 seconds from the start of heating, and a voltage $V_{S2}$ corresponding to an absolute humidity detected after 2 minutes from the start of heating are evaluated and then a difference between those voltages ($V_{S2}-V_{S1}$) is calculated. Then, determination is made as to in what range the voltage difference ($V_{S2}-V_{S1}$) corresponding to the humidity increase rate exists.

If the voltage difference ($V_{S2}-V_{S1}$) is a value 0.5 V or more, corresponding to the range of a predetermined humidity increase rate, it is determined that because the vessel containing the food has no cover and the quantity of the food is small, the food is rapidly heated and a large quantity of vapor generated from the food is directly emitted in the heating chamber 3. Based on such determinations, a first humidity level $V_{SA1}$ ($=V_{S1}+2.5$ volts) is set and heating is performed until the detected absolute humidity attains the first humidity level $V_{SA1}$. When the detected absolute humidity attains the first humidity level $V_{SA1}$, the heating is temporarily stopped. During this temporary stop, seasonings are added to the food or the food is stirred. After that, heating is restarted with a microwave output of 50%.

A period $K_1 \cdot TA$, which is obtained by multiplication of time TA required for the detected absolute humidity to attain the first humidity level $V_{SA1}$ after the start of heating by the predetermined coefficient $K_1$ ($=2.5$), is set, while a humidity level $V_{SB}$ ($=V_{S3}+2$ volts) is set based on an absolute humidity $V_{S3}$ detected after 15 seconds from the restart of heating. Heating is further performed until the above mentioned period $K_1 \cdot TA$ has passed or until the detected absolute humidity attains the humidity level $V_{SB}$. However, the period $K_1 \cdot TA$ is usually elapsed before the detected absolute humidity attains the humidity level $V_{SB}$. Accordingly, the heating is usually terminated when the period $K_1 \cdot TA$ has passed. It is only in case the period $K_1 \cdot TA$ is prolonged for one cause or another that the heating is terminated when the detected absolute humidity attains the humidity level $V_{SB}$.

On the other hand, if the above described voltage difference ($V_{S2}-V_{S1}$) is a value in the range from 0.1 volt to less than 0.5 volt, corresponding to another predetermined humidity increase rate, it is determined that generated vapor is directly emitted in the heating chamber 3 although heating of the food progresses slowly and the quantity of the generated vapor is small because no cover is placed on the vessel containing the food and the quantity of the food is large. Based on such determinations, a first humidity level $V_{SA1}'$ ($=V_{S1}+2$ volts) is set and heating is performed until the detected absolute humidity attains the first humidity level $V_{SA1}'$. When the detected absolute humidity attains the first humidity level $V_{SA1}'$, the heating is temporarily stopped and thereafter the same heating control as in the case of the voltage difference ($V_{SA}-V_{S1}$) being 0.5 volt or more is performed.

If the voltage difference ($V_{S2}-V_{S1}$) is a value smaller than 0.1 volt, corresponding to a further predetermined humidity change rate, it is determined that the quantity of vapor emitted in the heating chamber 3 is considerably small irrespective of the quantity of the food because the vessel containing the food is covered. Based on such determination, a second humidity level $V_{SA2}$ ($V_{S1}=0.3$ volt) is set and heating is performed until the detected absolute humidity attains the second humidity level $V_{SA2}$. When the detected absolute humidity attains the second humidity level $V_{SA2}$, the heating is temporarily stopped. During this temporary stop, seasonings are added to the food or the food is stirred. After that, heating is restarted with a microwave output of 50%.

The heating thus restarted is continued for a period obtained by multiplication of time TA required for the detected output humidity to attain the second humidity level $V_{SA1}$ after the start of heating by a coefficient dependent on the length of this time TA.

More specifically, if the above mentioned time TA is equal to or longer than 6 minutes, it is determined that heating progresses slowly because of the large quantity of the food and accordingly that emission of vapor from the food is slow and the detected absolute humidity does not rapidly attain the second humidity level $V_{SA2}$. Thus, a coefficient $K_2$ ($=2$) is set based on such determinations. Accordingly, the heating period thereafter is $K_2 \cdot TA$.

On the other hand, if the above mentioned time TA is equal to or longer than 5 minutes and shorter than 6 minutes, it is determined that the quantity of the food is medium, that heating progresses faster than in the case of the time TA of 6 minutes or more, and accordingly that the detected absolute humidity attains the second humidity level $V_{SA2}$ relatively fast because emission of vapor from the food is relatively fast. Based on such determinations, a coefficient $K_2'$ ($=3$) is set. Accordingly, the heating period thereafter is $K_2' \cdot TA$.

If the above mentioned required time TA is shorter than 5 minutes, it is determined that heating progresses fast because of the small quantity of the food, and accordingly that the detected absolute humidity attains the second humidity level $V_{SA2}$ fast because vapor is generated from the food rapidly. Based on such determinations, a coefficient $K_2''$ ($=4$) is set. Accordingly, the heating period thereafter is $K_2'' \cdot TA$.

In any of the above described cases, the humidity level $V_{SB}$ ($=V_{S3}+2$ volts) is set based on the absolute humidity $V_{S3}$ detected after 15 seconds from the restart of heating and if any of the heating periods $K_2 \cdot TA$, $K_2' \cdot TA$, $K_2'' \cdot TA$ is prolonged for some cause or other, the heating is terminated based on the humidity level $V_{SB}$.

As described above, the first cooking sequence for making casserole has five heating courses, because generation of vapor differs dependent on the quantity of the food and whether or not the vessel containing the food is covered or not. Thus, the most suitable finish of the food can be obtained for each course corresponding to the quantity of the food and the existence or nonexistence of the cover.

Table 1 below shows heating conditions for each of the five heating courses.

TABLE 1

| | | | |
|---|---|---|---|
| 1st heating course small quantity, not covered | $V_{S2} - V_{S1} \geqq 0.5$ | $V_{SA1}$ $(= V_{S1} + 2.5)$ | $K_1TA$ or $V_{SB}(=V_{S3} + 2)$ |
| 2nd heating course large quantity, not covered | $V_{S2} - V_{S1} \geqq 0.1$ $<0.5$ | $V_{SA1}'$ $(= V_{S1} + 2)$ | " |
| 3rd heating course large quantity, covered | $V_{S2} - V_{S1} < 0.1$ | $V_{SA2}$ $(V_{S1} + 0.3)$ | $TA \geqq 6$ min. $K_2TA$ or $V_{SB}(=V_{S3} + 2)$ |
| 4th heating course medium quantity, covered | " | " | 5 min. $\leqq TA < 6$ min. $K_2'TA$ or $V_{SB}(=V_{S3} + 2)$ |
| 5th heating course small quantity, covered | " | " | $TA < 5$ min. $K_2''TA$ or $V_{SB}(=V_{S3} + 2)$ |

Figure 17A:
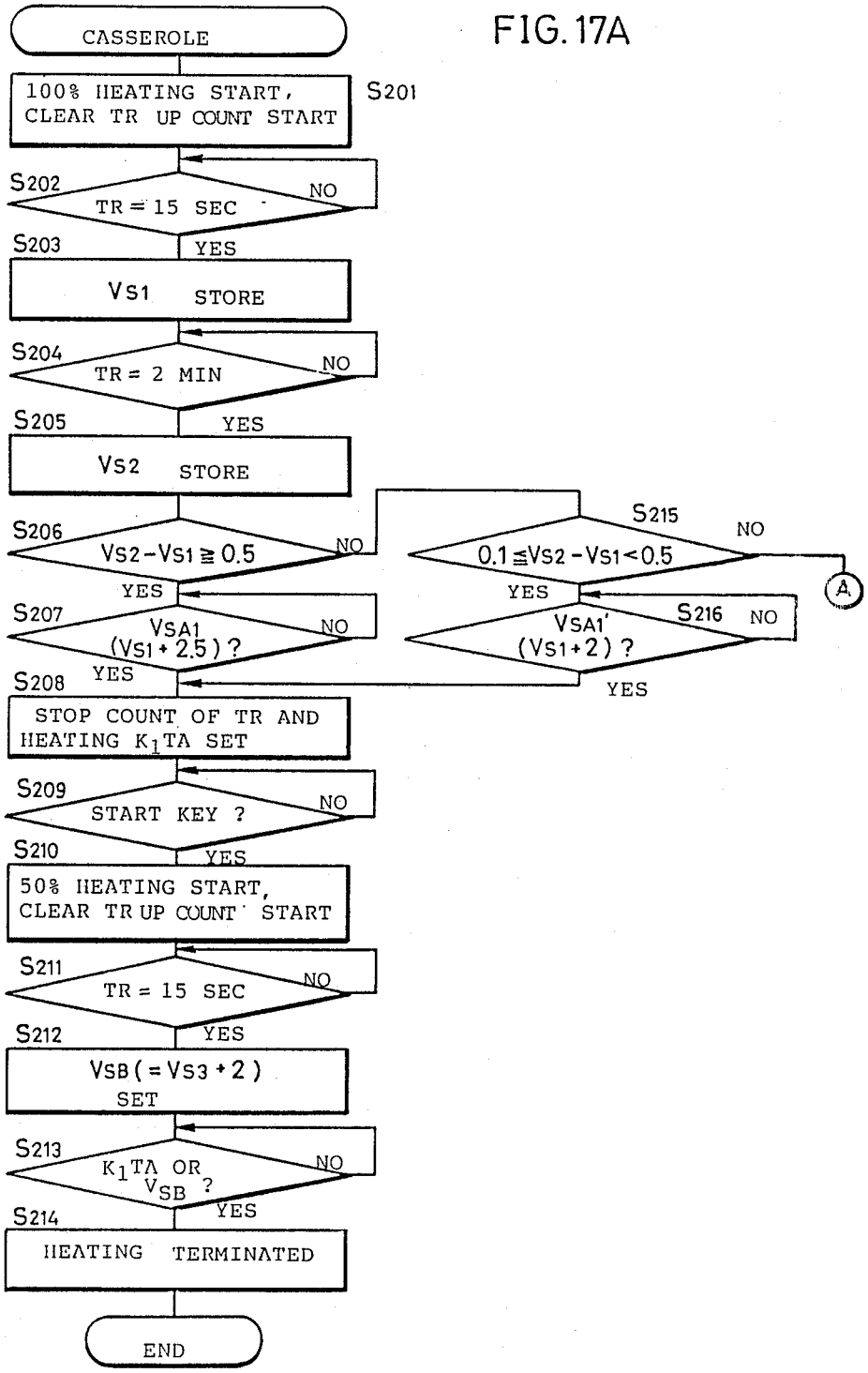
FIGS. 17A and 17B are flowcharts showing a control program of a microcomputer 12 for executing the first cooking sequence according to the third embodiment of the invention.
Figure 17B:
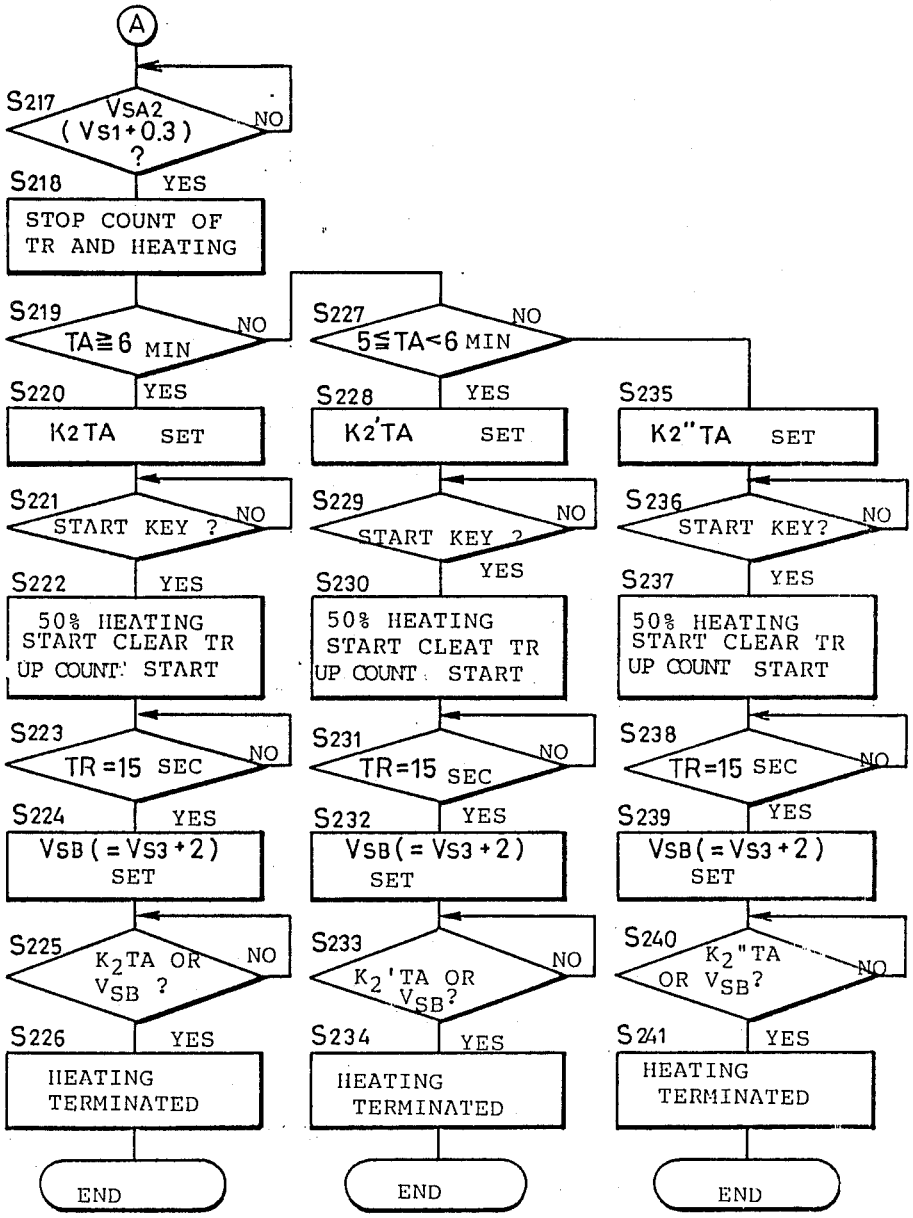

FIGS. 17A and 17B are flowcharts showing a control program of the microcomputer 12 for executing the first cooking sequence for casserole.

Referring now to FIGS. 16 to 17B, the control program for executing the first cooking sequence according to the third embodiment of the invention will be described.

First, when the casserole key 5a and the start key 7 on the keyboard 5 are operated, microwave heating with an output of 100% is started and a timer TR (not shown) in the microcomputer 12 is cleared in the step S201, so that the timer TR starts upward counting for determination of time. When it is determined (in the step S202) that the content of the timer TR is 15 seconds, the voltage $V_{S1}$ corresponding to an absolute humidity detected at that time is stored in a storage device (not shown) in the microcomputer 12 (in the step S203). Further, when it is determined (in the step S204) that the content of the timer TR is 2 minutes, the voltage $V_{S2}$ corresponding to the absolute humidity detected at that time is stored in the above mentioned storage device (in the step S205).

Then, the voltage difference $(V_{S2}-V_{S1})$ is calculated and when this voltage difference is 0.5 volt or more in the step S206, the first humidity level $V_{SA1}$ $(=V_{S1}+2.5$ volts) is set, so that heating is performed until the detected absolute humidity attains the second humidity level $V_{SA1}$ (in the step S207). When the detected absolute humidity attains the first humidity level $V_{SA1}$, the counting of the timer TR is stopped and the heating is temporarily stopped. Further, the period $K_1 \cdot TA$ obtained by multiplication of the content of the timer TR, i.e., the required time TA till then by the predetermined coefficient $K_1$ is set (in the step S208). Then, after seasonings are added to the food or the food is stirred, the start key 7 is operated again (in the step S209). As a result, heating is restarted with an output of 50% and the timer TR is cleared, whereby upward counting for determination of time is started (in the step S210). subsequently, when it is determined that the content of the timer TR is 15 seconds (in the step S211), the voltage $V_{S3}$ corresponding to the absolute humidity detected at that time is stored in the above mentioned storage device and the humidity level $V_{SB}$ $(=V_{S3}+2$ volts) is set (in the step S212). Then, heating is performed until the above mentioned period $K_1 \cdot TA$ has passed or until the detected absolute humidity attains the humidity level $V_{SB}$ (in the step S213). Since the elapse of the period $K_1 \cdot TA$ usually comes earlier as described above, the heating is terminated with the elapse of the period $K_1 \cdot TA$ (in the step S214).

When it is determined (in the step S215) that the voltage different $(V_{S2}-V_{S1})$ is in the range from 0.1 volt to less than 0.5 volt, another first humidity level $V_{SA1}'$ $(=V_{S1}+2$ volts) is set and heating is performed until the detected absolute humidity attains this first humidity level $V_{SA1}'$ (in the step S216). Subsequently, the above described steps S208 to S214 are executed.

When it is determined (in the step S215) that the voltage different $(V_{S2}-V_{S1})$ is smaller than 0.1 volt, a second humidity level $V_{SA2}$ $(=V_{S1}+0.3$ volt) is set and heating is performed until the detected absolute humidity attains the second humidity level $V_{SA2}$ (in the step S217 shown in FIG. 17B). When the detected absolute humidity attains the second humidity level $V_{SA2}$, the counting of the timer TR is stopped and the heating is temporarily stopped (in the step S218).

Then, when it is determined (in the step S219) that the content of the timer TR, i.e., the required time TA till then is equal to or longer than 6 minutes, the period $K_2 \cdot TA$ obtained by multiplication of the time TA by the predetermined coefficient $K_2$ (in the step S220) is set. After seasonings are added to the food or the food is stirred, the start key 7 is operated again (in the step S221). Then, the steps S222 to S226 are executed in the same manner as in the above described steps S210 to S214, except that in the step S225 the elapse of the period $K_2 \cdot TA$ is determined instead of the period $K_1 \cdot TA$.

When it is determined (in the step S227) that the elapsed time TA is equal to or longer than 5 minutes and shorter than 6 minutes, a period $K_2' \cdot TA$ obtained by multiplication of the time TA by a predetermined coefficient $K_2'$ is set (in the step S228). Then, the same steps S229 to S234 as in the above described steps S221 to S226 are executed. However, in the step S233, the elapse of the period $K_2' \cdot TA$, instead of the period $K_2 \cdot TA$, is determined.

When it is determined (in the step S227) that the elapsed time TA is shorter than 5 minutes, a period $K_2'' \cdot TA$ obtained by multiplication of the time TA by a predetermined coefficient $K_2''$ is set (in the step S235). Then, the same steps S236 to S241 as in the above described steps S221 to S226 are executed. However, in the step S240, the elapse of the period $K_2'' \cdot TA$ instead of the period $K_2 \cdot TA$, is determined.

Figure 18:
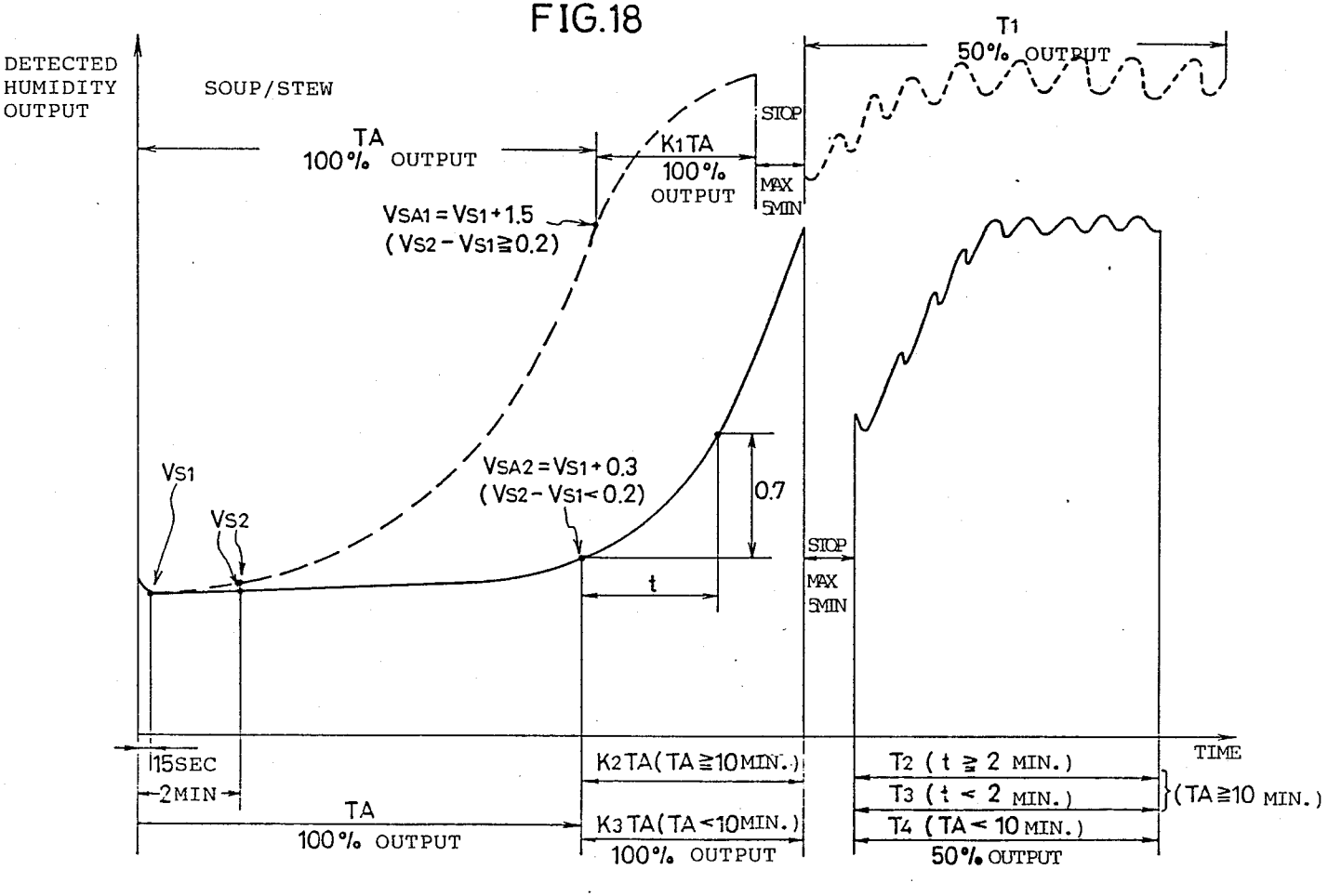
FIG. 18 is a graph for explaining a second cooking sequence according to the third embodiment of the invention.

FIG. 18 is a graph for explaining the second cooling sequence for making soup or stew, more particularly, a graph showing changes with time in an output of the humidity sensor 11, i.e., a detected absolute humidity. In FIG. 18, the abscissa represents time and the ordinate represents an output voltage of the humidity sensor 11.

In the following, the control program for executing the second cooking sequence for soup/stew will be described with reference to the graph of FIG. 18.

First, the soup/stew key 5b on the keyboard 5 is operated to select the second cooking sequence and the start key 7 is operated to instruct a start of heating. As a result, microwave heating with an output of 100% is started. Then, in the same manner as in the case of the first cooking sequence for casserole, a humidity increase rate at an early stage of heating is evaluated. More specifically, the voltage $V_{S1}$ corresponding to the absolute humidity detected after 15 seconds from the start of heating and the voltage $V_{S2}$ corresponding to the absolute humidity detected after 2 minutes from the start of heating are evaluated and the difference of those voltages ($V_{S2}-V_{S1}$) is calculated. Then, determination is made as to in what range the voltage difference ($V_{S2}-V_{S1}$) corresponding to the humidity increase rate exists.

First, if the voltage difference ($V_{S2}-V_{S1}$) is a value 0.2 volt or more, corresponding to a predetermined humidity increase rate, it is determined that vapor from the food is directly emitted into the heating chamber 3 because the vessel containing the food is not covered or that the food is heated fast because of the small quantity of the food to generate a large quantity of vapor. Based on such determination, a first humidity level $V_{SA1}$ ($=V_{S1}+1.5$ volt) is set and heating is performed until the detected absolute humidity attains this first humidity level $V_{SA1}$. When the detected absolute humidity attains the first humidity level $V_{SA1}'$ heating is further performed for the period $K_1 \cdot TA$ obtained by multiplication of the time TA required to attain the first humidity level $V_{SA1}$ after the start of heating by a predetermined coefficient $K_1$ (=0.8). After that, heating is temporarily stopped. During this temporarily stop, seasonings are added to the food or the food is stirred. After that, heating is restarted with a microwave output of 50% to continue for a predetermined period $T_1$ (=30 minutes). If heating is not restarted manually before five minutes pass, heating is automatically restarted at the moment that the five minutes passed.

On the other hand, if the voltage difference ($V_{S2}-V_{S1}$) is a value less than 0.2 volt, corresponding to the predetermined humidity increase rate, it is determined that the vessel containing the food is covered and that the quantity of vapor emitted into the heating chamber 3 is relatively small irrespective of the quantity of the food. Based on such determinations, a second humidity level $V_{SA2}$ ($=V_{S1}+0.3$ volt) is set and heating is performed until the detected absolute humidity attains the second humidity level $V_{SA2}$.

After that, heating is further continued for a period obtained by multiplication of the time TA required to attain the second humidity level $V_{SA2}$ after the start of heating by a coefficient dependent on the length of the time TA.

More specifically stated, if the above mentioned required time TA is equal to or longer than a predetermined time, i.e., 10 minutes, it is determined that heating progresses slowly because of the large quantity of the food, that generation of vapor from the food is slow and that the detected absolute humidity does not rapidly attain the second humidity level $V_{SA2}$. Then, the coefficient $K_2$ (=0.8) is set based on such determinations. Accordingly, the heating period thereafter is $K_2 \cdot TA$. The time t required for the detected absolute humidity level to further increase by 0.7 volt after it has attained the second humidity level $V_{SA2}$ is measured. After the period $K_2 \cdot TA$ has passed, heating is temporarily stopped for five minutes at the maximum as described above, and then heating is restarted with a microwave output of 50%.

The heating period after the restart is determined dependent on the humidity increase rate during the heating period $K_2 \cdot TA$, that is, the above mentioned time t. More specifically, if the time t is equal to or longer than 2 minutes, it is determined that heating progresses slowly because of a particularly large quantity of the food compared with usual cases of large quantity of food, or that heating of the food as a whole progresses slowly because the density of the food is low and convection of the food easily occurs, and accordingly that the detected absolute humidity does not rapidly attain the humidity level ($V_{SA2}+0.7$ volt). Then, heating is continued for a period $T_2$ (=60 minutes).

If the time t is shorter than 2 minutes, it is determined that heating progresses fast because of a relatively small quantity of the food compared with an average large quantity of food or that the food is partially heated fast because the density of the food is high and convection in the food does not easily occur, and accordingly that the detected absolute humidity rapidly attains the humidity level ($V_{SA2}+0.7$ volt). Then, heating is continued for a period $T_3$ (=50 minutes) based on such determinations.

In the above described embodiment, determination of the humidity increase rate during the heating period $K_2 \cdot TA$ is made based on the time t required for the detected absolute humidity to further increase by 0.7 volt after it has attained the second humidity level $V_{SA2}$. However, the determination may be made based on an increase rate $\Delta V$ of the humidity level for a predetermined period, e.g., one minute after it has attained the second humidity level $V_{SA2}$ conversely. In the latter case, if the increase rate $\Delta V$ is less than 0.3 volt, heating is continued for the period $T_2$. If the increase rate $\Delta V$ is 0.3 volt or more, heating is continued for the period $T_3$.

If the above mentioned required time TA is shorter than 10 minutes, it is determined that heating progresses fast because of the small quantity of the food and accordingly that vapor is rapidly generated from the food to cause the detected absolute himidity to rapidly attain the second humidity level $V_{SA2}$. Then, a coefficient $K_3$ (=0.5) is set based on such determinations. Thus, the heating period after the elapse of the time TA is $K_3 \cdot TA$.

After the period $K_3 \cdot TA$ has passed, heating is temporarily stopped for five minutes at the maximun as described above. After that, heating is restarted with a microwave output of 50% to continue for a predetermined period $T_4$ (=40 minutes).

As described above, the second cooking sequence for soup/stew has four heating courses according to different degress of generation of vapor dependent on the quantities of the food and whether the vessel containing the food is covered or not. Thus, appropriate finish of the food can be obtained for each course corresponding to the quantity of the food and the existence or nonexistence of cover.

Table 2 below shows heating conditions for each of the above described four heating courses.

TABLE 2

| | | | | |
|---|---|---|---|---|
| 1st heating course small quantity or not covered | $V_{S2} - V_{S1} \geqq 0.2$ | $V_{SA1}$ $(V_{S1} + 1.5)$ | $K_1TA$ | $T_1$ |
| 2nd heating course large quantity, covered relatively large or low density | $V_{S2} - V_{S1} < 0.2$ | $V_{SA2}$ $(V_{S1} + 0.3)$ | TA ≧ 10 min. $K_2TA$ | t ≧ 2 min. $T_2$ |
| 3rd heating course large quantity, covered relatively small or high density | " | " | " | t < 2 min. $T_3$ |
| 4th heating course small quantity, covered | " | " | TA < 10 min. $K_{32}TA$ | $T_4$ |

Figure 19A:
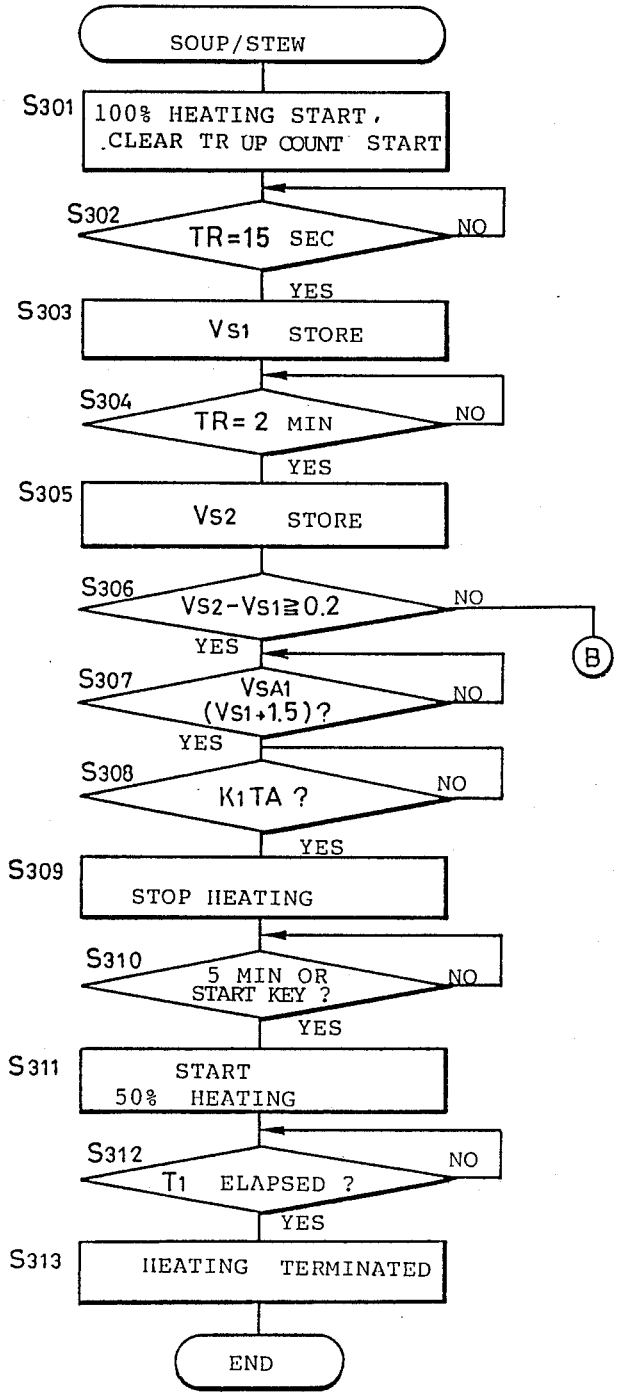
FIGS. 19A and 19B are flowcharts showing a control program of the microcomputer 12 for executing the second cooking sequence according to the third embodiment of the invention.
Figure 19B:
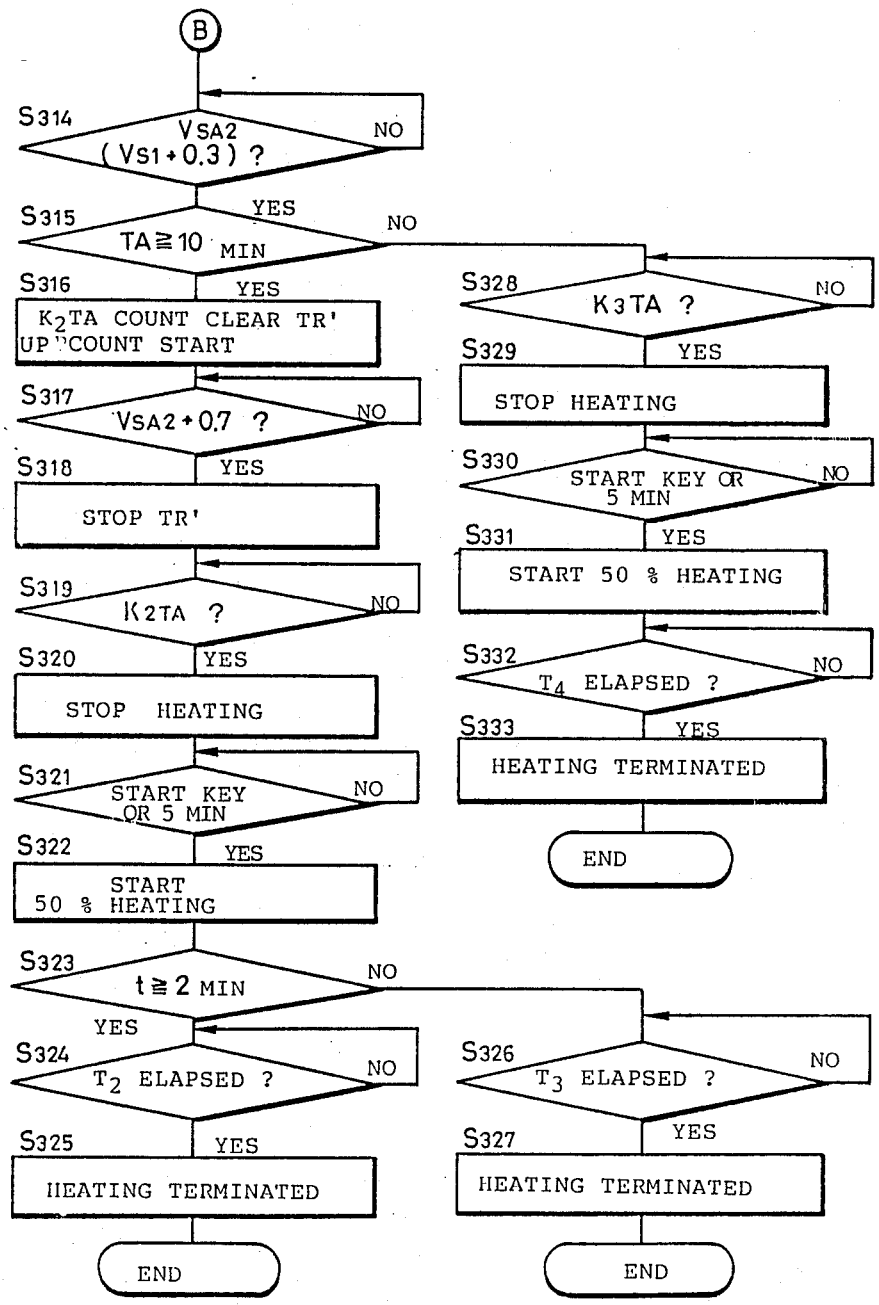

FIGS. 19A and 19B are flowcharts showing a control program of the microcomputer 12 for executing the above describe second cooking sequence for making soup/stew.

Referring to FIGS. 18 to 19B, the control program for executing the second cooking sequence according to the third embodiment of the invention will be described.

First, when the soup/stew key 5*b* and the start key 7 on the keyboard 5 are pressed, microwave heating with an output of 100% is started and the timer TR (not shown) in the microcomputer 12 is cleared in the step S301, whereby the timer TR starts upward counting for determination of time. When it is determined (in the step S302) that the content of the timer TR is 15 seconds, the voltage $V_{S1}$ corresponding to the absolute humidity detected at that time is stored in the storage device (not shown) in the microcomputer 12 (in the step S303). Further, when it is determined (in the step S304) that the content of the timer TR is 2 minutes, the voltage $V_{S2}$ corresponding to the absolute humidity detected at that time is stored in the above mentioned storage device (in the step S305).

Then, the voltage difference $(V_{S2}-V_{S1})$ is calculated and when it is determined (in the step S306) that the voltage difference is 0.2 volt or more, the first humidity level $V_{SA1}$ $(=V_{S1}+1.5$ volt) is set and heating is performed until the detected absolute humidity attains the first humidity level $V_{SA1}$ (in the step S307). Then, heating is further performed for the period $K_1 \cdot TA$ obtained by multiplication of the time TA required to attain the first humidity level $V_{SA1}$ after the start of heating by the predetermined coefficient $K_1$ (in the step S308). After the period $K_1 \cdot TA$ has passed, heating is temporarily stopped (in the step S309). Subsequently, when the start key 7 is operated again or when the temporary stop time attains 5 minutes (in the step S310), heating is restarted with an output of 50% (in the step S311). Then, when the elapse of the period $T_1$ is determined (in the step S312), the heating is terminated (in the step S313).

On the other hand, when it is determined (in the step S306) that the voltage difference $(V_{S2}-V_{S1})$ is less than 0.2 volt, the second humidity level $V_{SA2}$ $(=V_{S1}+0.3$ volt) is set and heating is performed until the detected absolute humidity attains the second humidity level $V_{SA2}$ (in the step S314 in FIG. 19B).

Subsequently, when it is determined (in the step S315) that the content of the timer TR, that is, the required time TA till then is 10 minutes or more, counting for determination of the period $K_2 \cdot TA$ is started and another timer TR′ (not shown) in the microcomputer 12 is cleared to start upward counting (in the step S316). When it is determined (in the step S317) that the detected absolute humidity attains the humidity level $(V_{SA2}+0.7$ volt), counting by the timer TR′ is stopped (in the step S318). After that, when the elapse of the period $K_2 \cdot TA$ is determined (in the step S319), heating is temporarily stopped (in the step S320). After that, when the start key 7 is operated again or when the temporary stop time attains 5 minutes (in the step S321), heating is restarted with an output of 50% (in the step S322).

When it is determined (in the step S323) that the content of the above mentioned timer TR′, that is, the time t required for the detected absolute humidity level to further increase by 0.7 volt after it has attained the second humidity level $V_{SA2}$ is 2 minutes or more, it is determined (in the step S324) whether or not the period $T_2$ has passed after the restart of heating. When the passage of the period $T_2$ is determined, the heating is terminated (in the step S325).

On the other hand, when it is determined (in the step S323) that the time t is less than 2 minutes, it is determined whether or not the period $T_3$ has passed after the restart of heating (in the step S326) and when the passage of the period $T_3$ is determined, the heating is terminated (in the step S327).

Further, when it is determined (in the step S315) that the required time TA is less than 10 minutes, the same steps S328 to S333 as the above described steps S308 to S313 are executed. However, in the step S328, the elapse of the period $K_3 \cdot TA$, instead of the period $K_1 \cdot TA$, is determined and in the step S322, the elapse of the period $T_4$, instead of the period $T_1$, is determined.

As described above, according to the third embodiment of the invention, the most appropriate heating course is selected to be executed out of the plurality of heating courses in each of the cooking sequences for casserole and for soup/stew, based on the determinations of the humidity change rate at the early stage of heating and other factors such as the required time or the humidity change rates thereafter. Thus, the most suitable finish of the food can be obtained irrespective of the quantity of the food and whether the vessel containing the food is covered or not.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronically controlled cooking apparatus comprising:

a heating chamber where an object to be heated is placed, means for heating said object placed in said heating chamber, means for detecting humidity in said heating chamber, and control means for controlling a heating operation by said heating means in response to to the humidity in said heating chamber detected by said detecting means, wherein said control means comprises:

first evaluation means for evaluating a humidity change rate in said heating chamber at an early stage of said heating operation based on said detected humidity, first determination means for determining a state of said object being heated based on the humidity change rate evaluated by said first evaluation means, second evaluation means for evaluating a specified factor concerning the state of said object during said heating operation and after the determination by said first determination means, second determination means for determining the state of said object based on said specified factor evaluated by said second evaluation means, and means for determining a heating pattern suited for the state of said object based on the determinations by said first and second determination means, said first determination means making a determination at least as to whether a cover is placed over said object being heated, and said second determination means making a determination at least as to a quantity of contents of said object being heated.

2. An electronically controlled cooking apparatus in according with claim 1, wherein said second evaluation means evaluates, as said specified factor, a humidity change rate in said heating chamber after the early stage of said heating operation.

3. An electronically controlled cooking apparatus in accordance with claim 2, wherein said heating pattern determination means comprises:

means for evaluating time required for the detected humidity to attain a predetermined first level from the start of said heating operation when said first determination means determines that the cover is placed over said object to be heated, and means for determining time for after-heating of said object based on said evaluated time and the determination by said second determination means.

4. An electronically controlled cooking apparatus in accordance with claim 2, wherein said heating pattern determination means comprises means for determining a target humidity level at the time of after-heating of said object, based on the determination by said second determination means, when said first determination means determines that the cover is placed over said object.

5. An electronically controlled cooking apparatus in accordance with claim 2, wherein said heating pattern determination means comprises means for performing heating until the detected humidity attains a predetermined second level, when said first determination means determines that the cover is placed over said object, said second evaluation means evaluates a humidity change rate for a predetermined time after said detected humidity has attained said second level, said heating pattern determination means further comprises means for evaluating a time elapsing from the start of said heating operation to an end of said predetermined time and means for determining a time for after-heating of said object, based on said evaluated time and the determination by said second determination means.

6. An electronically controlled cooking apparatus in accordance with claim 2, wherein said heating pattern determination means comprises means for performing heating until the detected humidity attains a third level, when said first determination means determines that a gap exists to a given extent between said object and said cover, said second evaluation means evaluates a humidity change rate for a predetermined time, after the determination by said first determination means, said heating pattern determination means further comprises means for evaluating a time required for the detected humidity to attain said third level from the start of said heating operation, and means for determining a time for after-heating of said object, based on said evaluated time and the determination by said second determination means.

7. An electronically controlled cooking apparatus in accordance with claim 1, wherein said second evaluation means evaluates, as said specified factor, a time required for the detected humidity to attain a fourth level determined based on the determination by said first determination means after the early stage of said heating operation.

8. An electronically controlled cooking apparatus in accordance with claim 7, wherein said heating pattern determination means comprises means for determining a time for after-heating of said object, based on the determination by said second determination means.

9. An electronically controlled cooking apparatus in accordance with claim 8, wherein said after-heating time determination means determines an after-heating time of said object based on the time evaluated by said second evaluation means and the predetermined coefficient, when said first determination means determines that no cover is placed over said object.

10. An electronically controlled cooking apparatus in accordance with claim 8, wherein said after-heating time determination means determines an after-heating time of said object based on the time evaluated by said second evaluation means and a coefficient determined based on said time, when said first determination means determines that the cover is placed over said object.

11. An electronically controlled cooking apparatus in accordance with claim 8, wherein said after-heating time determination means determines a predetermined after-heating time based on the time evaluated by said second evaluation means, when said first determination means determines that the cover is placed over said object.

12. An electronically controlled cooking apparatus in accordance with claim 11, wherein said heating pattern determination means comprises:

means for further performing heating operation for the time determined based on the evaluated time and the coefficient determined based on said time, after the evaluation of the time by said second evaluation means, means for detecting the humidity change rate in said heating chamber during the heating operation for said determined time, and means for determining the predetermined after-heating time based on said detected humidity change rate.

13. An electronically controlled cooking apparatus in accordance with claim 12, wherein said humidity change rate is represented as time required for the detected humidity to increase by a given level during the heating operation for said determined time.

14. An electronically controlled cooking apparatus in accordance with claim 12, wherein said humidity change rate is represented as an increase rate of the detected humidity level for a given period during the heating operation for said determined time.

15. An electronically controlled cooking apparatus in accordance with claim 8, wherein said control means comprises means for temporarily stopping said heating operation prior to start of after-heating.

16. An electronically controlled cooking apparatus in accordance with claim 15, wherein said control means comprises means for changing an output of said heating means dependent on whether it is before or after the temporary stop of said heating operation.

17. An electronically controlled cooking apparatus in accordance with claim 1, wherein said first determination means makes a determination as to the manner of placing said cover suitable for said heating pattern if the cover is placed over the object.

18. An electronically controlled cooking apparatus, comprising:

a heating chamber where an object to be heated is placed, means for heating said object placed in said heating chamber, means for detecting a humidity in said heating chamber, and control means for controlling a heating operation by said heating means with respect to the humidity in said heating chamber detected by said detecting means, wherein said control means comprises:

first evaluation means for evaluating a humidity change rate in said heating chamber at an early stage of said heating operation based on said detected humidity, first determination means for determining a state of said object being heated based on the humidity change rate evaluated by said first evaluation means, second evaluation means for evaluating a specified factor concerning the state of said object during said heating operation and after the determination by said first determination means, second determination means for determining the state of said object, based on said specified factor evaluated by said second evaluation means, and said control means stopping operation of said heating means at least when the detected humidity in said heating chamber attains a predetermined high level before the determination by said first determination means.

19. A method of cooking, comprising the steps of:

heating an object placed in a heating chamber;

detecting humidity in the chamber, controlling the step of heating with respect to the detected humidity, the step of controlling including:

first evaluating a humidity change rate in the chamber at any early stage of the step of heating based on the detected humidity, first determining a state of the object being heated based on the evaluated humidity change rate, second evaluating a specified factor concerning the state of the object during the step of heating and after the step of first determining, second determining of the state of the object based on the evaluated specified factor, and determining a heating pattern suited to the state of the object based on the steps of first and second determining, the step of first determining including making a determination at least as to whether a cover is placed over the object being heated, the step of second determining including making a determination at least as to a quantity of contents of the object being heated.

20. A method in accordance with claim 19, wherein the step of first determining includes making a determination as to the manner of placing the cover if the cover is placed over the object.

21. A method in accordance with claim 19, wherein the step of second evaluating includes evaluating a humidity change rate in the chamber as the specified factor after the early stage of the step of heating.

22. A method in accordance with claim 19, wherein the step of controlling further includes stopping the step of heating at least when the detected humidity in the chamber attains a predetermined high level before the step of first determining takes place.

* * * * *

UNITED STATES PATENT AND TRADEMARK OFFICE

CERTIFICATE OF CORRECTION

PATENT NO. : 4,864,088

DATED : September 5, 1989

INVENTOR(S) : Kiyoshi Hiejima, Hiroyuki Uehashi, Yoriko Fishitani, Toshitada Kojima It is certified that error appears in the above-identified patent and that said Letters Patent is hereby corrected as shown below:

Column 6, line 66: change "hands" to --hand--.

Column 16, line 31: change "$^{V}$SA1" to --$^{V}$SA2--.

Column 17, line 3: delete --or not--.

Column 17, line 61: change "subse-" to --Subse---.

Column 18, line 65: change "TA" to --TA,--.

Column 18, line 68: change "cooling" to --cooking--.

Column 19, line 40: change "temporarily" to --temporary--.

Column 20, line 50: change "himidity" to --humidity--.

Column 21, table 2: change "$K_{32}$ TA" --$K_3$TA--.

Column 22, line 47: change "S322" to --S332--.

Column 23, line 8: delete --to-- [second occurrence.]

Signed and Sealed this

Second Day of October, 1990

*Attest:*

HARRY F. MANBECK, JR.

*Attesting Officer*

*Commissioner of Patents and Trademarks*